US006116157A

United States Patent [19]

Hayama et al.

[11] Patent Number: 6,116,157

[45] **Date of Patent: *Sep. 12, 2000**

[54] PRINTING METHOD AND APPARATUS

[75] Inventors: Hitoshi Hayama, Nagano; Kenji Watanabe, Tokyo; Takanobu Kameda, Tokyo; Tomoyuki Shimmura, Tokyo, all of Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/773,557

[22] Filed: Dec. 27, 1996

[30] Foreign Application Priority Data

Dec. 28, 1995 [JP] Japan ..... 7-341995
May 20, 1996 [JP] Japan ..... 8-124516

[51] Int. Cl.[7] ..... B05C 17/06

[52] U.S. Cl. ..... 101/114; 101/128.4

[58] Field of Search ..... 101/114, 121, 101/124, 125, 128.4, 463.1, 467, 470

[56] References Cited

U.S. PATENT DOCUMENTS 3,585,928 6/1971 Kaneko ..... 101/401.1
3,841,215 10/1974 Hasegawa ..... 101/148
5,337,668 8/1994 Matsuoka et al. ..... 101/481
5,487,340 1/1996 Kanai ..... 101/486
5,692,438 12/1997 Kanai ..... 101/128.1
5,782,179 7/1998 Kagawa et al. ..... 101/128.4
5,809,879 9/1998 Yokoyama et al. ..... 101/128.4

*Primary Examiner*—John Hilten
*Attorney, Agent, or Firm*—Loeb & Loeb LLP

[57] ABSTRACT

There are provided a printing method of printing an image of characters, figures or the like on a plate-making surface of a plate-making sheet, and an apparatus therefor. The apparatus feeds a plate-making sheet by a predetermined amount assigned to a forward end of the plate-making sheet when the forward end is detected by a sensor. When a mark for detection provided on the plate-making sheet is detected during the feeding of the plate-making sheet by the predetermined amount assigned to the forward end, the apparatus further feeds the plate-making sheet by a predetermined amount from a position of the plate-making sheet where the mark for detection is detected, to thereby locate the start of an image-forming area of the plate-making sheet. On the other hand, when the mark for detection is not detected, the apparatus continues feeding of the plate-making sheet. The apparatus executes printing based on print data in response to an instruction for printing while feeding the plate-making sheet, when the start of the image-forming area of the stamp-making surface of the plate-making sheet has been located.

35 Claims, 21 Drawing Sheets

SQUARE STAMP (SMALL)

SQUARE STAMP (LARGE)

PERSONAL NAME STAMP

BUSINESS STAMP (SMALL)

BUSINESS STAMP (LARGE)

ADDRESS STAMP

MAXIMUM SIZE STAMP

FIG. 18

| STATE NO. | STATE | SENSOR | PLATEN ROLLER | PROCESSING STEPS |
|---|---|---|---|---|
| SN1 | 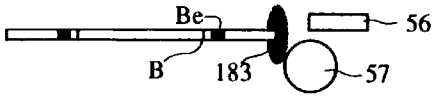  | FORWARD END DETECTED | START ROTATION | INSERT SHEET TO PLATEN |
| SN2 | 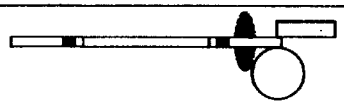 | CHECK FOR DETECTING HOLE | ROTATE WHILE CHECKING FOR HOLE | START FEEDING |
| SN3 | 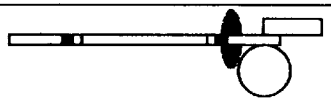 | DETECTING HOLE DETECTED | START ROTATION FOR LOCATING SHEET | TERMINATE CHECKING FOR SHEET POSITION |
| SN4 | 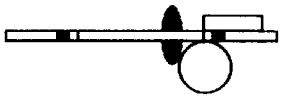 | IDLE | STOP TEMPORARILY | TERMINATE LOCATING OF SHEET |
| SN5 | 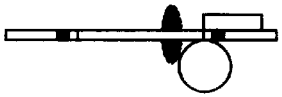 | IDLE | START ROTATION FOR PRINTING | START PRINTING |
| SN6 | 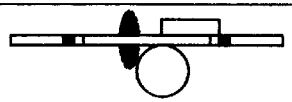 | IDLE | ROTATE FOR PRINTING | PRINTING |
| SN7 | 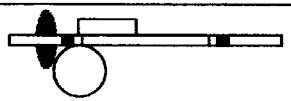 | CHECK FOR BACKWARD END | TERMINATE ROTATION FOR PRINTING ; START ROTATION FOR DISCHARGE | TERMINATE PRINTING START DISCHARGE |
| SN8 | 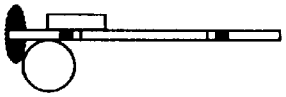 | BACKWARD END DETECTED | ROTATE FOR DISCHARGE & RIBBON FEED | DISCHARGE START FEEDING INK RIBBON |
| SN9 | 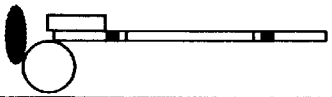 | IDLE | TERMINATE ROTATION FOR DISCHARGE & RIBONN FEED | TERMINATE FEEDING INK RIBBON |

FIG. 19

| TITLE | LEVEL1 | LEVEL2 |
|---|---|---|
| ENVIRON-MENT | BEEPER | OFF ON |
| | DENSITY | +3 ⌴ +2 ⌴ +1 ⌴ NORMAL -1 ⌴ -2 ⌴ -3 ⌴ |
| | DEMO MODE | |
| | POSITION | PRO7 ⌴ PRO6 ⌴ PRO5 ⌴ PRO4 ⌴ PRO3 ⌴ PRO2 ⌴ PRO1 ⌴ NORMAL<br>RETRO1 ⌴ RETRO2 ⌴ RETRO3 ⌴ RETRO4 ⌴ RETRO5 ⌴ RETRO6 ⌴ RETRO7 ⌴ |

FIG. 22A

CHECK SHEET !

FIG. 22B

1 TEXT

FIG. 22C

FEEDING SHEET

PRINTING METHOD AND APPARATUS

BACKGROUND OF THE INVENTION

1. Field of the Invention

This invention relates to a method of printing an image of letters, figures, or the like on a plate-making surface of a plate-making sheet in the form of a strip, and an apparatus therefor.

2. Prior Art

Conventionally, there has been proposed a printing apparatus for printing an image of letters, figures or the like on a plate-making surface of a continuous plate-making sheet. The continuous plate-making sheet, which is contained in a cassette as a roll, is set in the printing apparatus, and rolled out for being printed with desired letters, figures, etc. by a print head of the apparatus. A printed portion of the plate-making sheet including a margin thereof is cut off from the remainder. The plate-making sheet is a laminate of a front-side sheet and a reverse-side sheet attached to the front-side sheet. A front-side sheet portion of the plate-making sheet is peeled off a reverse-side sheet portion of the same. The front-side sheet portion printed with the image of letters, figures, etc. is affixed to a place where the image is needed, by the use of an adhesive provided on the underside thereof.

When the continuous plate-mating sheet contained in a cassette as a roll is used, the user simply sets the cassette in position within the printing apparatus, before he starts entering desired letters for plate-making. When a plate-making sheet in the form of a strip is used, however, it is required first to discriminate between a right side (front side) and a wrong side (underside) of the plate-making sheet, and then to print an image at a predetermined location thereon. However, if these works are delegated to the user, there is a fear of errors, and the works themselves are troublesome. Further, this type of plate-making sheet is inconvenient to handle unless it can be fed using either end as a forward end for printing. It is also required that when a plate-making sheet of a quite different or non-conforming type has been inserted erroneously, the apparatus should detect the insertion of such an unsuitable plate-making sheet immediately, and make the user aware of the abnormality to permit him to deal with the abnormality promptly.

Finally, these requirements should be met without undesirably increasing the size of the apparatus, or decreasing the size of the same at the cost of reliability of operation thereof.

SUMMARY OF THE INVENTION

It is a first object of the invention to provide a printing method which is capable of printing an image of letters, figures or the like in a desired area on a plate-making surface of a plate-making sheet in the form of a strip, by simple operations.

It is a second object of the invention to provide a printing apparatus which is capable of printing an image of characters, figures or the like in a desired area on a plate-making surface of a plate-making sheet in the form of a strip, by simple operations.

To attain the first object, according to a first aspect of the invention, there is provided a printing method of printing an image on a plate-making surface of a plate-making sheet while feeding the plate-making sheet, the plate-making sheet being in the form of a strip and having a mark for detection provided at a predetermined location thereon.

The printing method according to the first aspect of the invention is characterized by comprising the steps of feeding the plate-making sheet by a predetermined amount assigned to a forward end of the plate-making sheet when the forward end is detected by a sensor, on one hand, further feeding the plate-making sheet by a predetermined amount for locating a start of an image-forming area of the plate-making surface of the plate-making sheet from a position of the plate-making sheet where the mark for detection is detected, when the mark for detection is detected by the sensor during the feeding of the plate-making sheet by the amount assigned to the forward end of the plate-making sheet, to thereby locate the start of the image-forming area of the plate-making surface of the plate-making sheet, but on the other hand, continuing feeding of the plate-making sheet when the mark for detection is not detected, and in response to an instruction for printing, printing the image on the plate-making surface of the plate-making sheet based on print data while feeding the plate-making sheet, when the start of the image-forming area of the plate-making surface is located.

According to the printing method of the first aspect of the invention, when a plate-making sheet is inserted into the apparatus and then a forward end of the plate-making sheet is detected by the sensor, the plate-making sheet is fed by the predetermined amount assigned to the forward end thereof. When the mark for detection of the plate-making sheet is detected by the sensor during feeding of the plate-making sheet by the predetermined amount, the plate-making sheet is further fed by the predetermined amount for locating the start of an image-forming area of a plate-making surface of the plate-making sheet, to thereby locate the start of the image-forming area of the plate-making sheet to place the same on standby for printing. When the mark for detection is not detected, which means that the plate-making sheet is set with a wrong-side for print or that a plate-making sheet of a non-conforming type has been inserted, the feeding of the plate-making sheet is continued without executing printing. On the other hand, when the mark for detection is detected and the start of the image-forming area of the plate-making surface of the plate-making sheet is located, in response to an instruction for printing, the printing is executed based on print data while feeding the plate-making sheet. In short, according to this printing method, by detecting the mark for detection by the sensor, it is possible to feed the plate-making sheet by the predetermined amount upon detection of the mark to thereby accurately locate the start of the image-forming area of the plate-making surface thereof, so that an image can be printed at a predetermined location on the plate-making surface by simple manual operations. Further, an abnormality can be easily detected, for example, when the plate-making sheet is set with a wrong-side for print or when a plate-making sheet of a non-conforming type has been inserted, so that it is possible to prevent printing from being executed in such an abnormal state.

Preferably, the mark for detection is provided in the vicinity of an upper-side edge and a lower-side edge of the plate-making sheet at centrosymmetric locations with respect to a center of the plate-making sheet.

According to this preferred embodiment, the plate-making sheet has both ends formed exactly alike, so that it is possible to insert the plate-making sheet into the apparatus using either end as a forward end, which makes it easy for the user to handle the plate-making apparatus.

Preferably, the predetermined amount for locating the start of the image-forming area of the plate-making sheet is adjustable.

According to this preferred embodiment, the printing method is capable of compensating for or absorbing variations among individual apparatuses in respect of mechanical accuracy of a mechanism for feeding a plate-making sheet and other mechanical component parts, so that it is unnecessary to make tolerances of the mechanism and mechanical component parts very tight, and at the same time the user can shift the start of the image-forming area to a desired location on the plate-making surface of the plate-making sheet.

To attain the first object, according to a second aspect of the invention, there is provided a printing method of printing an image on a plate-making surface of a plate-making sheet while feeding the plate-making sheet, the plate-making sheet being in the form of a strip and having a mark for detection provided at a predetermined location thereon.

The printing method according to the second aspect of the invention is characterized by comprising the steps of feeding the plate-making sheet by a predetermined amount assigned to a forward end of the plate-making sheet when the forward end is detected by a sensor, on one hand, further feeding the plate-making sheet by a predetermined amount for locating a start of an image-forming area of the plate-making surface of the plate-making sheet from a position of the plate-making sheet where the mark for detection is detected, when the mark for detection is detected by the sensor during the feeding of the plate-making sheet by the amount assigned to the forward end of the plate-making sheet, to thereby locate the start of the image-forming area of the plate-making surface of the plate-making sheet, but on the other hand, giving an alarm when the mark for detection is not detected, to make a user aware that there was an abnormality in detecting the mark for detection, and in response to an instruction for printing, printing the image on the plate-making surface of the plate-making sheet based on print data while feeding the plate-making sheet, when the start of the image-forming area of the plate-making surface has been located.

Similarly to the printing method according to the first aspect of the invention, the printing method of the second aspect of the invention makes it possible to locate the start of an image-forming area of a plate-making surface of the plate-making sheet by feeding the sheet by the predetermined amount upon detection of the mark by the sensor. Therefore it is possible to print an image at a predetermined location on the plate-making surface by simple operations. On the other hand, when the mark for detection is not detected, e.g. when the plate-making sheet is set with a wrong-side for print or when a plate-making sheet of an non-conforming type is inserted, an alarm is given to make a user aware that there was an abnormality in detecting the mark. The user made aware of such an abnormality can deal with the same promptly.

Preferably, only feeding of the plate-making sheet is permitted when the mark for detection is not detected.

According to this preferred embodiment, when the mark for detection is not detected, e.g. when the plate-making sheet is set with a wrong-side for print or when a plate-making sheet of a non-conforming type has been inserted, not only the alarm is given to make the user aware that there was an abnormality in detecting the mark for detection, but also only the feeding of the plate-making sheet is permitted, thereby not only enabling the plate-making sheet to be discharged but also prevent other operations including printing from being executed in such an abnormal state.

Still preferably, the predetermined amount for locating the start of the image-forming area of the plate-making sheet is adjustable.

Preferably, the mark for detection is provided in the vicinity of an upper-side edge and a lower-side edge of the plate-making sheet at centrosymmetric locations with respect to a center of the plate-making sheet.

In the first and second aspects of the invention, preferably, the printing method further includes a step of feeding the plate-making sheet by a predetermined amount from a position of the plate-making sheet where a backward end of the plate-making sheet is detected, in response to a detection signal delivered by the sensor when the backward end of the plate-making sheet is detected, to thereby discharge the plate-making sheet.

According to this preferred embodiment, in both cases of the plate-making sheet being simply continued to be fed, and the plate-making sheet being fed while being printed, when the sensor detects the backward end of the plate-making sheet, the plate-making sheet is further fed by the predetermined amount to thereby reliably discharge the plate-making sheet. That is, even when the plate-making sheet is fed with a wrong-side for print, or the same is not of a conforming type, the backward end of the plate-making sheet is detected, and then the plate-making sheet is discharged, so that it is possible to prevent the plate-making sheet from being stopped halfway, but reliably discharge the same.

In the first and second aspects of the invention, preferably, the printing method further includes steps of feeding the plate-making sheet after completion of the printing by a predetermined amount from a position of the plate-making sheet where the printing is completed, and on one hand, feeding the plate-making sheet by a predetermined amount from a position of the plate-making sheet where the backward end is detected, when the backward end is detected by the sensor during the feeding of the plate-making sheet by the predetermined amount after completion of the printing, to thereby discharge the plate-making sheet, but on the other hand, giving an alarm when the backward end is not detected to make a user aware that there was an abnormality in detecting the backward end of the plate-making sheet.

According to this preferred embodiment, it is possible to detect a backward end of a plate-making sheet during feeding of the plate-making sheet by a predetermined amount after completion of printing, and then further feed the plate-making sheet by a predetermined amount to discharge the plate-making sheet in a reliable manner. On the other hand, when the backward end is not detected, an alarm is given to make a user aware that there has occurred an abnormality in detecting the backward end of the plate-making sheet. For example, when the plate-making sheet is not fed properly during execution of printing to cause free turning of a platen roller or a twist of accompanying feeding sheet, such as an ink ribbon, resulting in an insufficient amount of feed of the plate-making sheet, or when a plate-making sheet of a non-conforming type has been inserted into the apparatus, the backward end of the plate-making sheet cannot be detected during the feeding of the plate-making sheet by the predetermined amount after completion of the printing, so that the alarm is given to make the user aware of the abnormality and urge him to deal with the abnormality.

Still preferably, only feeding of the plate-making sheet is permitted when the backward end is not detected.

According to this preferred embodiment, when the backward end of the plate-making sheet is not detected, not only an alarm is given to make the user aware that there was an abnormality in detecting the backward end of the plate-making sheet, but also only the feeding of the plate-making sheet is permitted, whereby it is possible to discharge the plate-making sheet in a reliable manner without proceeding to other processing operations in such an abnormal state.

To attain the second object, according to a third aspect of the invention, there is provided a printing apparatus for printing an image on a plate-making surface of a plate-making sheet while feeding the plate-making sheet, the plate-making sheet being in the form of a strip and having a mark for detection provided at a predetermined location thereon.

The printing apparatus according to the third aspect of the invention is characterized by comprising feeding means for feeding a plate-making sheet, a print head for printing an image on the plate-making surface of the plate-making sheet based on print data, a sensor arranged at a location upstream of the print head, and control means for controlling operation of the feeding means and operation of the print head in response to a detection signal delivered by the sensor. The control means causes the feeding means to feed the plate-making sheet by a predetermined amount assigned to a forward end of the plate-making sheet when the forward end is detected by the sensor. When the mark for detection is detected by the sensor during the feeding of the plate-making sheet by the feeding means by the predetermined amount assigned to the forward end of the plate-making sheet, the control means causes the feeding means to further feed the plate-making sheet by a predetermined amount for locating a start of an image-forming area of the plate-making surface of the plate-making sheet, from a position of the plate-making sheet where the mark for detection is detected, to thereby locate the start of the image-forming area of the plate-making surface of the plate-making sheet, and causes the print head to execute printing while causing the feeding means to feed the plate-making sheet, whereas when the mark for detection is not detected, the control means causes the feeding means to continue feeding of the plate-making sheet.

The printing apparatus of the third aspect of the invention provides the same effects as obtained by the printing method according to the first aspect of the invention.

Preferably, the mark for detection is provided in the vicinity of an upper-side edge and a lower-side edge of the plate-making sheet at centrosymmetric locations with respect to a center of the plate-making sheet.

Preferably, the control means is capable of adjusting the predetermined amount for locating the start of the image-forming area of the plate-making sheet.

According to this preferred embodiment, the printing apparatus is capable of compensating for or absorbing variations among individual apparatuses in respect of mechanical accuracy of a mechanism for feeding a plate-making sheet and other mechanical component parts, so that it is unnecessary to make tolerances of the mechanism and mechanical component parts very tight, and at the same time the user can shift the start of the image-forming area to a desired location on the plate-making surface of the plate-making sheet.

Preferably, the predetermined amount assigned to the forward end of the plate-making sheet is equal to an amount of feed corresponding to one to ten seconds in terms of time over which the plate-making sheet is fed.

According to this preferred embodiment, it is possible to detect an abnormal insertion of the plate-making sheet at an early stage, so that the user can feel at ease in operating the apparatus and at the same time deal with the abnormality promptly.

Preferably, insertion of the plate-making sheet is always permitted except in specified cases.

According to this preferred embodiment, when the plate-making sheet is inserted, the plate-making sheet is always accepted unless the apparatus suffers from an error, and has the start of the image-forming area of thereof located to be placed on standby for printing, so that the user can feel at ease in operating the apparatus.

To attain the second object, according to a fourth aspect of the invention, there is provided a printing apparatus for printing an image on a plate-making surface of a plate-making sheet while feeding the plate-making sheet, the plate-making sheet being in the form of a strip and having a mark for detection provided at a predetermined location thereon.

The printing apparatus according to the fourth aspect of the invention is characterized by comprising feeding means for feeding a plate-making sheet, alarm means for giving an alarm when an abnormality occurs, a print head for printing an image on the plate-making surface of the plate-making sheet based on print data, a sensor arranged at a location upstream of the print head, and control means for controlling operation of the feeding means, operation of the alarm means, and operation of the print head in response to a detection signal delivered by the sensor. The control means causes the feeding means to feed the plate-making sheet by a predetermined amount assigned to a forward end of the plate-making sheet when the forward end is detected by the sensor. When the mark for detection is detected by the sensor during the feeding of the plate-making sheet by the feeding means by the predetermined amount assigned to the forward end of the plate-making sheet, the control means causes the feeding means to further feed the plate-making sheet by a predetermined amount for locating a start of an image-forming area of the plate-making surface of the plate-making sheet, from a position of the plate-making sheet where the mark for detection is detected, to thereby locate the start of the image-forming area of the plate-making surface of the plate-making sheet, and causes the print head to execute printing while causing the feeding means to feed the plate-making sheet, whereas when the mark for detection is not detected, the control means causes the alarm means to give an alarm to make a user aware that there was an abnormality in detecting the mark for detection.

The printing apparatus according to the fourth aspect of the invention provides the same effect as obtained by the printing method according to the second aspect of the invention.

Preferably, the control means permits only feeding of the plate-making sheet when the mark for detection is not detected by the sensor.

According to this preferred embodiment, when the mark for detection is not detected, e.g. when the plate-making sheet is set with a wrong-side for print or when a plate-making sheet of a non-conforming type has been inserted, not only the alarm is given to make the user aware that there was an abnormality in detecting the mark for detection, but also only the feeding of the plate-making sheet is permitted, thereby not only enabling the plate-making sheet to be discharged but also preventing other operations including printing from being executed in such an abnormal state.

Preferably, the mark for detection is provided in the vicinity of an upper-side edge and a lower-side edge of the plate-making sheet at centrosymmetric locations with respect to a center of the plate-making sheet.

Preferably, the control means is capable of adjusting the predetermined amount for locating the start of the image-forming area of the plate-making sheet.

Preferably, the predetermined amount assigned to the forward end of the plate-making sheet is equal to an amount of feed corresponding to one to ten seconds in terms of time over which the plate-making sheet is fed.

Preferably, insertion of the plate-making sheet is always permitted except in specified cases.

In the third and fourth aspects of the invention, preferably, the control means causes the feeding means to feed the plate-making sheet by a predetermined amount from a position of the plate-making sheet where a backward end of the plate-making sheet is detected, in response to a detection signal delivered by the sensor when the backward end is detected, to thereby discharge the plate-making sheet.

According to this preferred embodiment, in both cases of the plate-making sheet being simply continued to be fed, and the plate-making sheet being fed while being printed, when the sensor detects the backward end of the plate-making sheet, the plate-making sheet is further fed by the predetermined amount to thereby reliably discharge the plate-making sheet. That is, even when the plate-making sheet is fed with a wrong-side for print, or it is not of a conforming type, the backward end of the plate-making sheet is detected and then, the plate-making sheet is discharged, so that it is possible to prevent the plate-making sheet from being stopped halfway, but reliably discharge the same.

In the third and fourth aspects of the invention, preferably, the forward end, the marks for detection and the backward end are detected by a single optical sensor.

According to this preferred embodiment, it is not only possible to reduce the size of apparatus, but also attain higher reliability of operation of the apparatus than when an mechanical sensor is employed.

In the third aspect of the invention, preferably, the printing apparatus further includes alarm means for giving an alarm when an abnormality occurs. The control means further controls operation of the alarm means. The control means causes the feeding means to feed the plate-making sheet after completion of the printing by a predetermined amount from a position of the plate-making sheet where printing is completed. When the backward end is detected by the sensor during the feeding of the plate-making sheet by the predetermined amount after the completion of the printing, the control means causes the feeding means to further feed the plate-making sheet by a predetermined amount from a position of the plate-making sheet where the backward end is detected, to thereby discharge the plate-making sheet, whereas when the backward end of the plate-making sheet is not detected by the sensor, the control means causes the alarm means to give an alarm to make a user aware that there was an abnormality in detecting the backward end.

In the fourth aspect of the invention, preferably, the control means causes the feeding means to feed the plate-making sheet after completion of the printing by a predetermined amount from a position of the plate-making sheet where printing is completed. When the backward end is detected by the sensor during the feeding of the plate-making sheet by the predetermined amount after the completion of the printing, the control means causes the feeding means to further feed the plate-making sheet by a predetermined amount from a position of the plate-making sheet where the backward end is detected, to thereby discharge the plate-making sheet, whereas when the backward end of the plate-making sheet is not detected by the sensor, the control means causes the alarm means to give an alarm to make a user aware that there was an abnormality in detecting the backward end.

According to these preferred embodiments, it is possible to detect a backward end of a plate-making sheet during feeding of the plate-making sheet by a predetermined amount after completion of printing, and then further feed the plate-making sheet by a predetermined amount to discharge the plate-making sheet in a reliable manner. On the other hand, when the backward end is not detected, an alarm is given to make a user aware that there has occurred an abnormality in detecting the backward end of the plate-making sheet. For example, when the plate-making sheet is not fed properly during execution of printing to cause free turning of a platen roller or a twist of feeding sheet, such as an ink ribbon, resulting in an insufficient amount of feed of the plate-making sheet, or when a plate-making sheet of a non-conforming type has been inserted into the apparatus, the backward end of the plate-making sheet cannot be detected during the feeding of the plate-making sheet by the predetermined amount after completion of the printing, so that the alarm is given to make the user aware of the abnormality and urge him to deal with the abnormality.

Preferably, the control means permits only feeding of the plate-making sheet when the backward end is not detected by the sensor.

The above and other objects, features, and advantages of the invention will become more apparent from the following detailed description taken in conjunction with the accompanying drawings.

BRIEF DESCRIPTION OF THE DRAWINGS

FIGS. 7A and 7B are diagrams which are useful in explaining construction of a stamp body of a square stamp, in which:

FIG. 7A shows the stamp body of the square stamp in a state mounted in the pocket; and FIG. 7B shows the bottom of the stamp body of the square stamp;

FIGS. 7C and 7D are diagrams which are useful in explaining construction of a stamp body of a business stamp, in which:

FIG. 7C shows the stamp body of the business stamp in a state mounted in the pocket; and FIG. 7D shows the bottom of the stamp body of the business stamp;

FIG. 18 shows a table which provides listing of processing steps from insertion of the plate-making sheet and discharge of the same;

FIG. 19 is a diagram showing options to be selected for setting an environment of internal processing of the stamp-making apparatus;

FIGS. 22A to 22C are samples of messages to be displayed on a display when an abnormality is detected.

DETAILED DESCRIPTION

The invention will now be described in detail with reference to the drawings showing embodiments thereof.

Figure 1A:
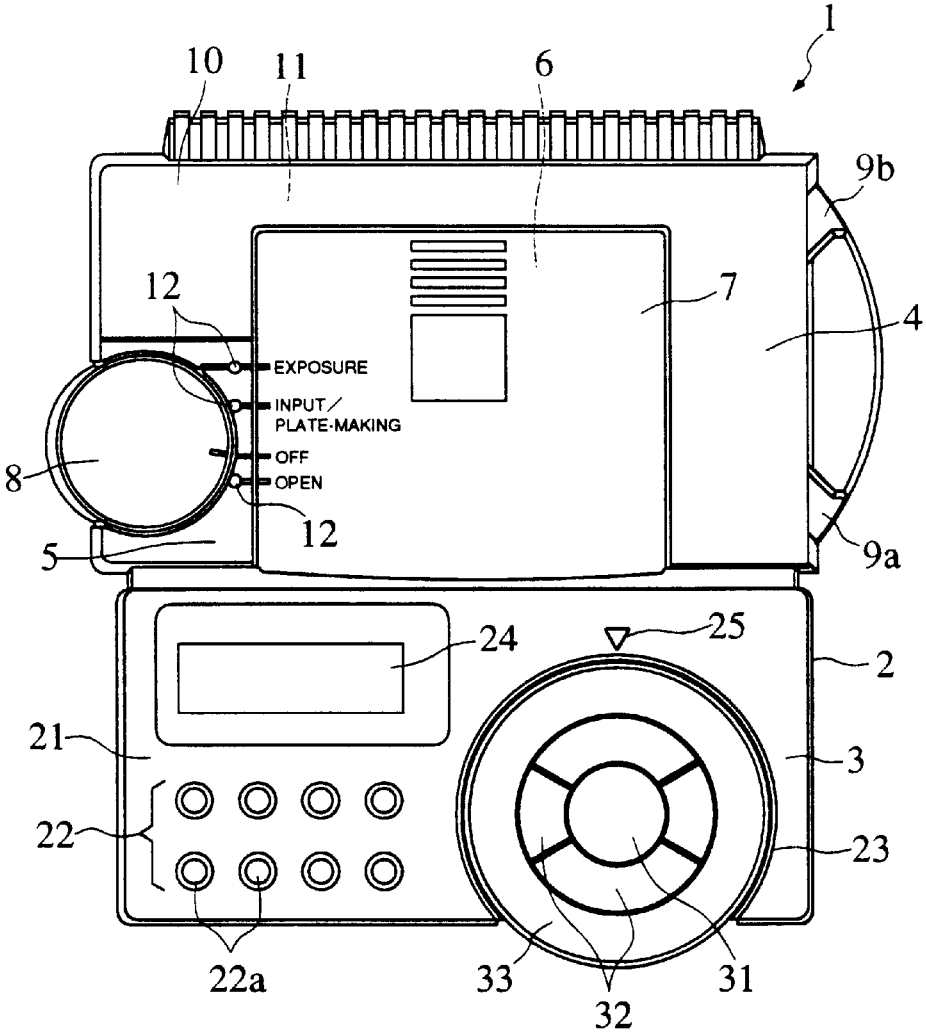
FIG. 1A is a plan view of an appearance of a stamp-making apparatus incorporating a printing apparatus according to an embodiment of the invention.
Figure 1B:
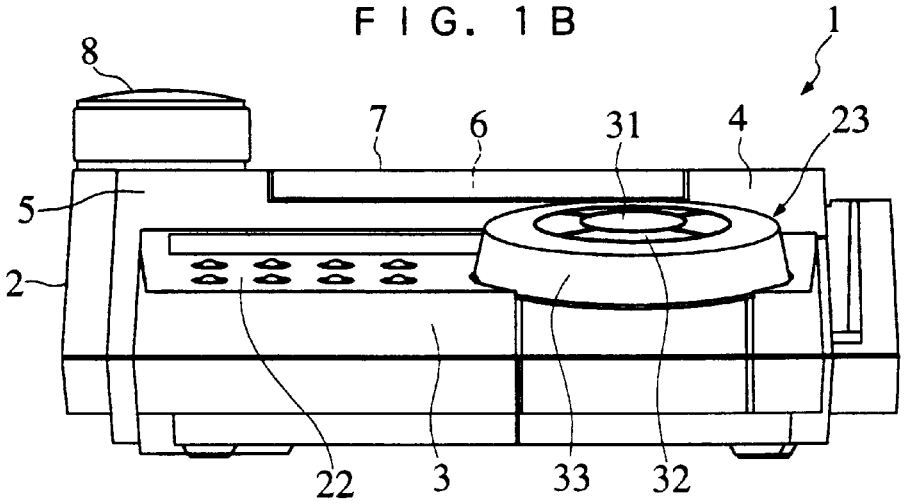
FIG. 1B is a front view of an appearance of the stamp-making apparatus.
Figure 11:
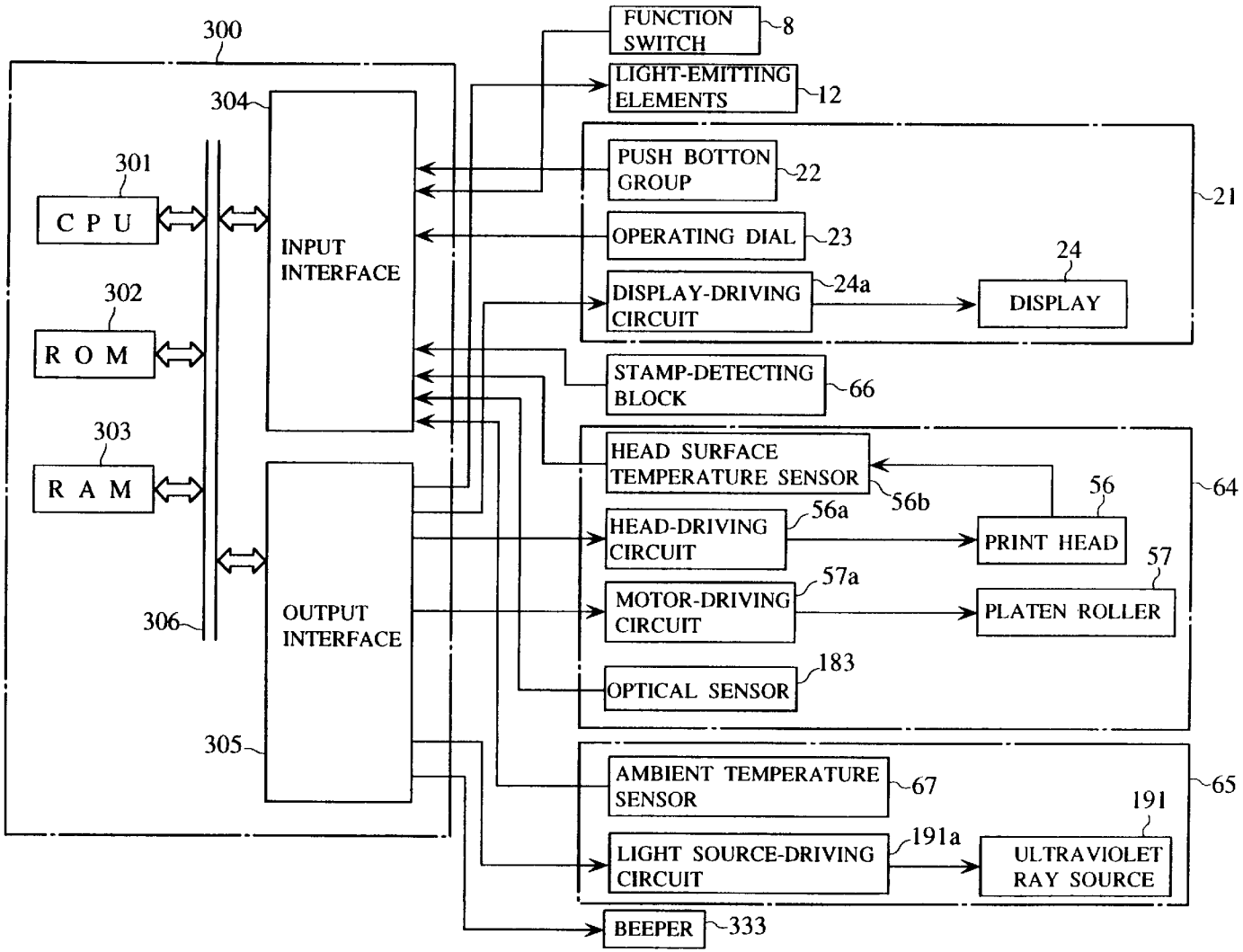
FIG. 11 is a block diagram of a control block and devices connected thereto of the stamp-making apparatus.

Referring first to FIGS. 1A and 1B, there is shown a stamp-making apparatus 1 which incorporating a printing apparatus according to an embodiment of the invention, and carries out the printing method of the present invention. The stamp-making apparatus makes a desired stamp by exposing a stamp body having a stamp surface made of ultraviolet-curing resin to ultraviolet rays via a mask of an ink ribbon printed with a stamp image including images of characters and patterns. The printing method and apparatus of the invention is directed to forming a mask on an ink ribbon. FIG. 1A is a plan view of the apparatus, while FIG. 1B is a front elevation of the same. FIG. 11 is a block diagram of a control system of the apparatus.

As shown in FIGS. 1A and 1B, the stamp-making apparatus 1 includes a casing 2 having upper and lower divisional portions, an electronic block 3 arranged in a front part of the casing 2, and a mechanical block 4 arranged in a rear part of the same. The mechanical block 4 is comprised of a mechanical block body 5, a pocket 6 formed in a central area of the mechanical block for receiving therein a stamp body A as a stamping-making object material to mount the stamp body A in the mechanical block body 5, and a lid 7 for opening and closing the pocket 6, which is formed with a window.

In a left side portion of the mechanical block 4 as viewed in the figures, a function switch 8 is provided for switching the operation of the stamp-making apparatus 1 between plate-making (printing) and exposure, as well as for permitting the lid 7 to be opened. At respective operating positions of the function switch 8, there are provided indications of "EXPOSURE", "INPUT/PLATE-MAKING", "OFF" and "OPEN", and provided at the operating positions of "EXPOSURE", "INPUT/PLATE-MAKING", and "OPEN" are respective light-emitting elements 12 connected to an output interface 305 of the control block 300.

Further, in a right side portion of the mechanical block 4, there are formed an inserting slot 9*a* for feeding a plate-making sheet B from which is made a stamp character label, referred to hereinafter, and a take-out slot 9*b* for delivering the plate-making sheet B therefrom. Further, the mechanical block 4 has a maintenance cover 10 removably mounted on part thereof outside the pocket 6, and an ink ribbon cartridge 11 carrying an ink ribbon C is mounted under the maintenance cover 10.

The electronic block 3 has an operating block 21 formed on the top thereof and contains the control block 300 therein. The operating block 21 includes a push button group 22 and an operating dial 23 both connected to the input interface 304 of the control block 300, and an display-driving circuit (not shown) connected to the output interface 305 of the control block 300 and a display 24 driven by the display-driving circuit 24*a*.

The operating dial 23 has a trial structure of an execution key 31 having a circular shape and arranged in the center, a cursor/conversion key 32 having four divisional blocks arranged along the outer periphery of the execution key 31 to form an annular shape, and a character input key 33 having an annular shape and arranged along the outer periphery of the cursor/conversion key 32. On the surface of the character input key 33, hirakana characters representative of the Japanese syllabary, not shown, etc. are printed. The inputting of stamp characters is carried out by first setting a character size by pushing a predetermined button 22*a* of the push button group 22, turning the character input key 33 to set each of desired hirakana characters to a triangle mark 25, and pushing the execution key 31 whenever each of the desired hirakana characters is set to the triangle mark 25, followed by converting desired ones of the input hirakana characters to kanji characters by operating the cursor/conversion key 32. When desired stamp characters are formed on the display 24, they are settled.

Figure 2:
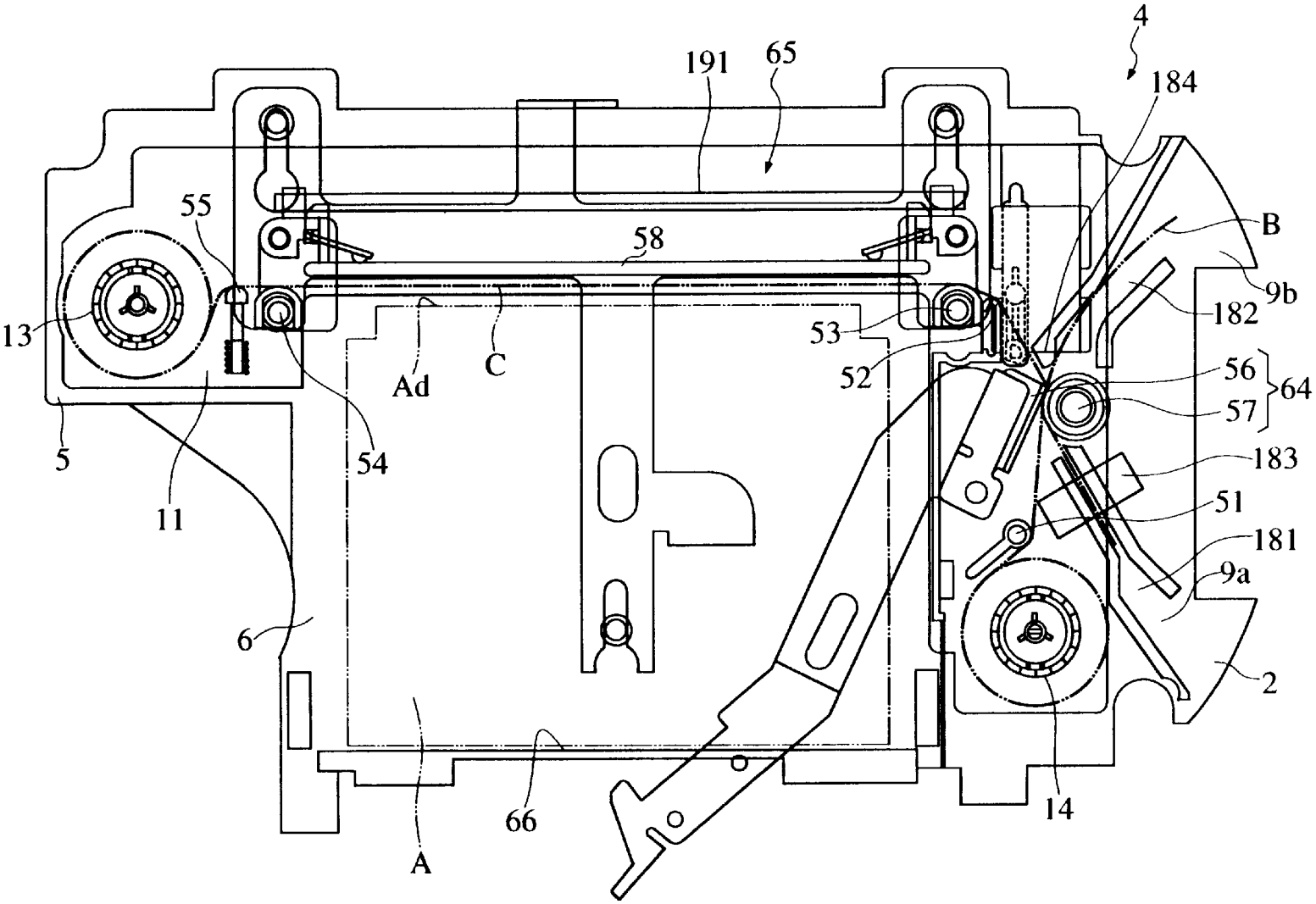
FIG. 2 is a plan view of an internal construction of a mechanical block of the stamp-making apparatus.

Now, a sequence of operations for making a stamp will be briefly described with reference to FIGS. 1A and 1B, and 2. First, the function switch 8 is rotated from "OFF" position as a standby position to "OPEN" position to open the lid 7, and a stamp body A is set in the pocket 6. As the stamp body A is set, the type of the stamp body A is detected by a stamp-detecting block 66 connected to the input interface 304 of the control block 300.

Then, the function switch 8 is rotated to "INPUT/PLATE-MAKING POSITION" to shift the function of the apparatus to plate-making, and the push button group 22 and the operating dial 23 are operated to input stamp characters. When the inputting of stamp characters is completed, the plate-making sheet B on which a stamp character label is provided is set by inserting the same into the inserting slot 9*a*.

Then, a predetermined button 22*a* of the push button group 22 is operated to cause the apparatus to execute the plate-making operation, i.e. printing of the stamp characters. The printing is effected simultaneously on the ink ribbon C and the plate-making sheet B. When the printing is completed, the ink ribbon (printed portion thereof) C is fed or advanced to set the same for exposure to ultraviolet rays, and at the same time plate-making sheet B is discharged from the take-out slot 9*b*. When it is confirmed by the plate-making sheet B discharged that there is no error in the printed stamp characters, the function switch 8 is rotated to the "EXPOSURE" position to shift the function of the apparatus to exposure, thereby causing an exposure block 65, referred to hereinafter, to perform exposure of the stamp body to ultraviolet rays.

When the exposure to ultraviolet rays is completed, the function switch 8 is rotated to the "OPEN" position to open the lid 7, and then the stamp body A is removed from the pocket 6 to wash the same. The washing completes the stamp. Before or after completion of the stamp, the stamp character label is peeled off the plate-making sheet B to attach the same on the back of the stamp.

Next, out of the component parts and elements of the stamp-making apparatus 1, ones associated with the control block 300, described in detail hereinafter, will be described with reference to FIGS. 2 to 11, one by one.

The ribbon cartridge 11 is constructed such that it is removable from the mechanical block body 5, and it is replaceable together with a casing thereof when the ink ribbon C is used up. As shown in FIG. 2, the ribbon cartridge 11 has a take-up reel 13 arranged at one end thereof and a supply reel 14 arranged at the other end thereof. The ink ribbon C is rolled out from the supply reel 14, fed along a feed path in the form of a rotation of an inverted-L shape as viewed in FIG. 2, and taken up by the take-up reel 13. The feed path in the form of a rotation of an inverted-L shape has a shorter side portion which a printing block 64, referred to hereinafter, faces and a longer side portion which the exposure block 65, referred to hereinafter, faces. The printing block 64 faces the ink ribbon C and the plate-making sheet B simultaneously, and the exposure block 65 faces the ink ribbon C printed with the image of the stamp characters.

The ink ribbon C is comprised of a transparent ribbon tape and ink coated thereon. In the present embodiment, it has a thickness of 6 $\mu$m. When the printing block 64 of the apparatus carries out printing on the ink ribbon C, a portion of ink coated on the ink ribbon, which defines a character, is transferred to the plate-making sheet B, whereby the ribbon tape of the ink ribbon C is formed with a negative image by a transparent portion from which the portion of ink defining the character has been transferred, while the plate-making sheet B is formed with a positive image by the transferred portion of ink defining the character. The ink ribbon C is sent forward to the exposure block 65 to use the resulting negative image-formed portion thereof as a mask in carrying out the exposure, while the plate-making sheet B is delivered from the apparatus for confirmation of the stamp characters and affixing the same to the stamp thus made.

Figure 4:
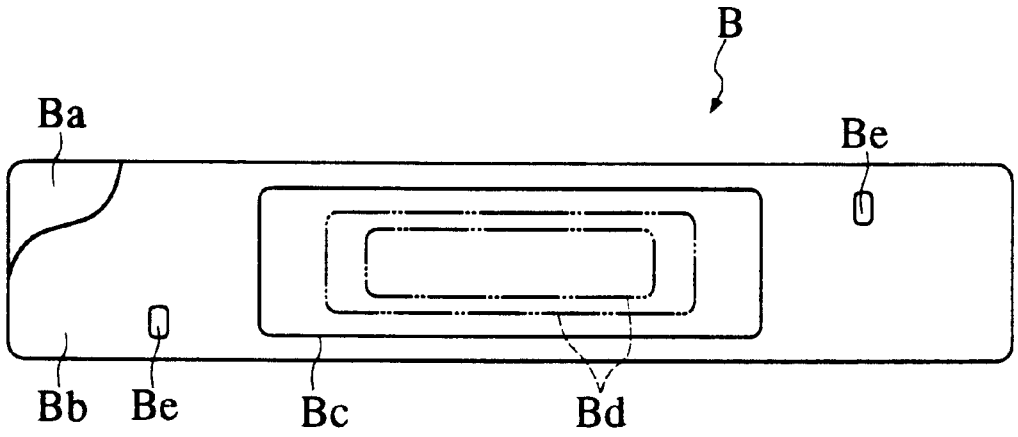
FIG. 4 is a view showing a structure of a plate-making sheet.

As shown in FIG. 4, the plate-making sheet B is a laminate of a base sheet Ba and an adhesive sheet Bb, generally in the form of a strip. The adhesive sheet Bb is formed with cutting lines Bc defining a rectangular area. The rectangular area of the adhesive sheet Bb is peeled off the base sheet Ba along the cutting lines Bc to form the stamp character label Bd to be affixed to the back of the stamp. There are provided several types of the stamp body A which are different in shape from each other according to the use of stamps, and there are also provided respective corresponding types of the plate-making sheet which are different in the shape of an area of the stamp character label Bd (shape and size of an area defined by cutting lines).

Figure 3:
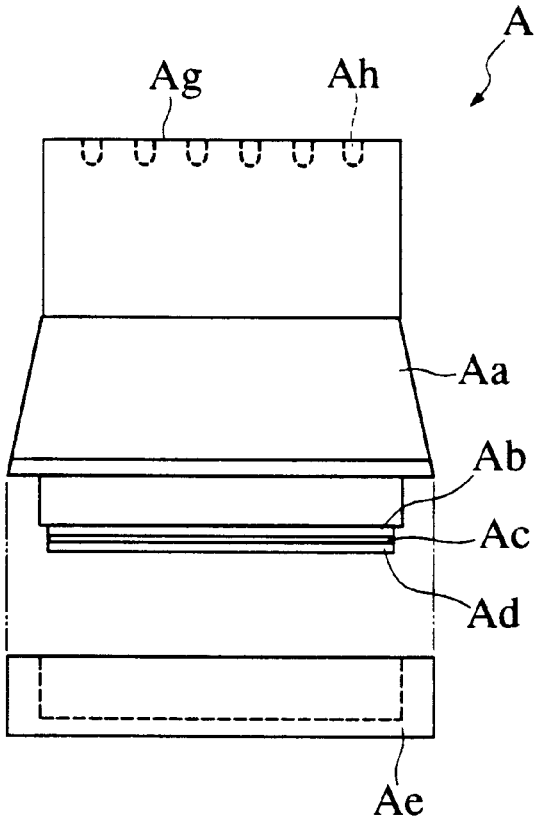
FIG. 3 is a view showing a structure of a stamp body.

On the other hand, as shown in FIG. 3, the stamp body A is comprised of a stock Aa (formed of a resin in the present embodiment), a thin sponge Ab (foamed urethane) affixed to a front end of the stock Aa, an ultraviolet-insensitive resin base Ac affixed to the sponge Ab, and an ultraviolet-curing resin affixed to the resin base Ac to form a stamp surface Ad. The ultraviolet-curing resin portion (stamp surface Ad) of the stamp body A is exposed to ultraviolet rays with the ink ribbon C as a mask, whereby portions of the stamp surface Ad corresponding to the stamp characters are cured. In this state, the stamp body A is taken out of the pocket 6, and washed with water to remove uncured portions of the stamp surface, which are soluble in water, from the stamp surface Ad. Thus the stamp is completed. Symbol Ae in the figure designates a cap made of resin.

Next, the printing block 64 will be described with reference to FIGS. 2 and 11. The printing block 64 includes a head-driving circuit 56*a* and a motor-driving circuit 57*a* both of which are connected to the output interface 305 of the control block 300, the print head (thermal head) 56 driven by the head-driving circuit 56*a* for printing stamp characters on the ink ribbon C, a platen roller 57 for feeding the ink ribbon C in a manner timed to printing operations of the print head 56, and a head temperature sensor 56*b* arranged on a head surface of the print head 56. Further, the casing 2 is formed with a feeding passage 181 through which the plate-making sheet B is fed to a contacting area between the print head 56 and the platen roller 57 and a delivery passage 182 through which the plate-making sheet B is delivered. The feeding passage 181 is formed with the inserting slot 9*a* which is open to the outside of the apparatus, at an upstream end thereof, and the delivery passage 182 is formed with the take-out slot 9*b* which is open to the outside of the apparatus, at a downstream end thereof.

The platen roller 57 is a drive roller as described hereinabove, and when the ink ribbon C is rolled out from the supply reel 14, it pulls in the plate-making sheet B between the print head 56 and itself to thereby bring a portion of the ink ribbon C and a portion of the plate-making sheet B, one upon the other, onto the print head 56. The print head 56 is a thermal head, and thermally transfer ink coated on the ribbon tape of the ink ribbon C to the plate-making sheet B. This transfer of the ink peels portions of ink corresponding to stamp characters off the ink ribbon C to reveal corresponding portions of the transparent base of the ribbon tape, while the peeled portions of the ink are attached to the plate-making sheet B as the stamp characters. The head surface temperature sensor 56*b* is formed by a temperature sensor, such as a thermistor, arranged on a surface of the print head 56 in an intimately contacting manner, and connected to the input interface 304 of the control block 300 for sending information of a temperature of the print head 56 detected thereby.

On the feeding passage 181 faces a sensor 183 which detects insertion of the plate-making sheet B and a feeding reference position of the same. The plate-making sheet B inserted into the feeding passage 181 is sent forward by the platen roller 57 depending on results of the detection of the sensor 183 whereby printing is started from one end of the stamp character label Bd. One of walls defining the delivery passage 182 on a left-hand side as viewed in FIG. 2 is formed with a separating nail 184 at an upstream end thereof, whereby the ink ribbon C and the plate-making sheet B being fed, one upon the other, are separated from each other. Thereafter, the ink ribbon C is sent forward to the exposure block, while the plate-making sheet B is delivered via the delivery passage 182 out of the apparatus.

Next, the exposure block 65 provided will be described with reference to FIGS. 2 and 11. The exposure block 65 includes a light source-driving circuit 191*a* connected to the output interface 305 of the control block 300, an ultraviolet ray source 191 arranged in a manner opposed to the stamp surface Ad of the stamp body A set in the pocket 6 and driven by the light source-driving circuit 191*a,* and a presser plate 58 arranged between the ultraviolet ray source 191 and the stamp surface Ad of the stamp body A. The ultraviolet ray source 191 is a self-heating hot-cathode tube called a semi-hot tube and supported on a fluorescent tube holder, not shown, provided on a base plate, not shown. The stamp surface Ad of the stamp body A, the presser plate 58, and the ultraviolet ray source 191 are arranged in a manner parallel to each other with a gap between adjacent ones thereof. The ink ribbon C is fed between the stamp surface Ad and the presser plate 58.

The presser plate 58 is formed e.g. of a transparent resin, and moves forward (downward as viewed in FIG. 2) to urge the ink ribbon C against the stamp surface Ad of the stamp body A. More specifically, the exposure is carried out by causing the presser plate 58 to urge the ink ribbon C against the stamp surface Ad of the stamp body A, and lighting the ultraviolet ray source 191 to thereby irradiate light to the ink ribbon C through the presser plate 58 (see FIG. 5). The exposure block 65 is provided with an ambient temperature sensor 67 which is formed by a thermistor as the like and connected to the input interface 304 of the control block 300, and sends information of a temperature of ambience of the exposure block 65 detected thereby to the input interface 304.

It should be noted that as the presser plate 58 is translated forward, the first guide pin 53 and the second guide pin 54 are moved in the same direction. This movement decreases the tension of the ink ribbon C stretched between the first and second guide pins 53, 54, whereby the ink ribbon C is urged against the stamp surface Ad of the stamp body A with reduced tension, i.e. without forming any vertical wrinkles thereon.

Now, the above-mentioned state of the ink ribbon C is described in further detail with reference to FIGS. 2 and 5. Referring to FIG. 2, when the ink ribbon C is fed or advanced, the pulling force of the take-up reel 13 causes strong tension of the ink ribbon C, so that vertical wrinkles are formed on the ink ribbon C due to its very small thickness. Therefore, if the ink ribbon C is urged against the stamp surface Ad of the stamp body A as it is, there remain the wrinkles formed on the ink ribbon C urged against the stamp surface Ad, so that deformed images (negative) of the stamp characters on the ink ribbon C are used in carrying out the exposure of the stamp surface Ad to the ultraviolet rays. On the other hand, if the ink ribbon C is loosened, the exposure can be carried out with the images of the stamp characters being out of position. To eliminate these inconveniences, as shown in FIG. 5, the first guide pin 53 and the second guide pin 54 are moved forward in accordance with the forward movement of the presser plate 58, whereby the tension of the ink ribbon C is reduced, and at the same time, a slight stretching force is applied to the ink ribbon C by the tension pin 55, which is moderate enough not to produce any wrinkles on the ink ribbon C.

Figure 5:
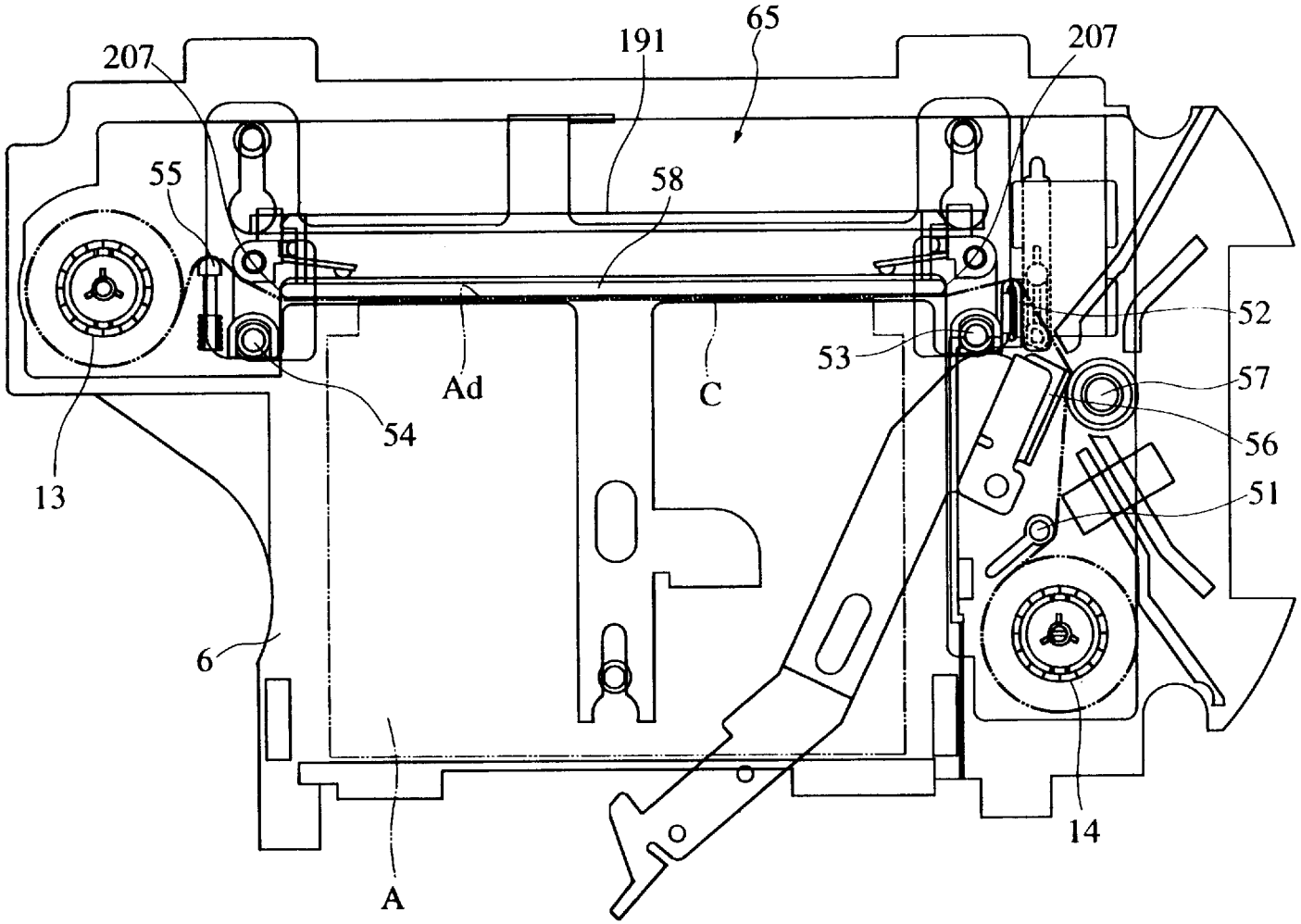
FIG. 5 is a plan view of an exposure system of the mechanical block and component parts associated therewith.
Figure 6:
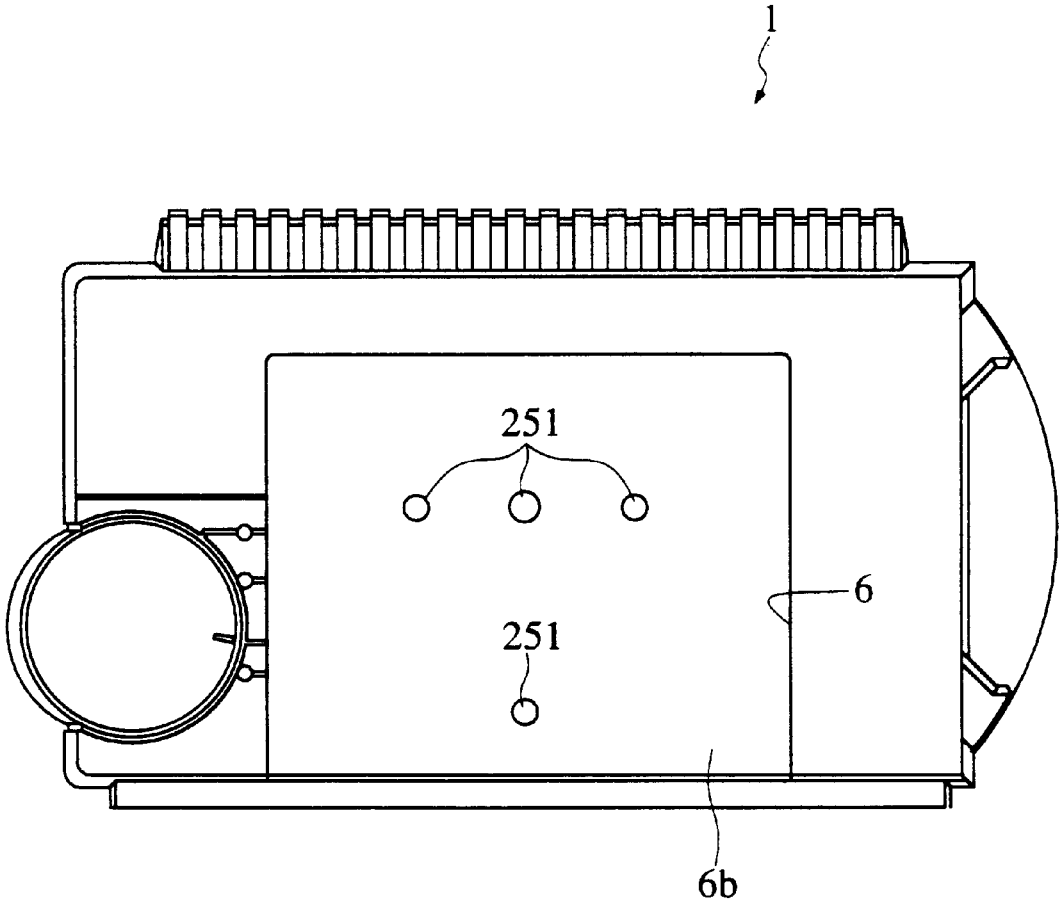
FIG. 6 is a plan view showing a pocket formed in the mechanical block with a lid removed therefrom.

Further, the ink ribbon C in the exposure position shown in FIG. 5 is bent backward at the longitudinal opposite ends of the presser plate 58 by the tension pin 55 and the second path-setting pin 52, and the chamfered portions 207 formed at the longitudinal opposite ends of the presser plate 58 operate to prevent undesired wrinkles from being produced on the ink ribbon C.

As described above, a positive image on the plate-making sheet B and a negative image on the ink ribbon C both formed by the printing are used as a stamp character label and an exposure mask, respectively. That is, the quality of these images directly reflects on the quality of a stamp as a final product. Especially, when the ink ribbon C, which is used as the exposure mask, is deformed, images of deformed characters are formed on the stamp body by the exposure. To eliminate this inconvenience, in addition to mechanical structural means for regulating the tension of the ink ribbon described above, electrical means of adjusting an amount of heat generated by the exposure process, described hereinafter, is provided to thereby preventing undesired wrinkles from being formed on the ink ribbon C.

Next, the stamp-detecting block 66, the operation of which is linked to the opening and closing of the lid 7, will be described. The stamp-detecting block 66 detects the mounting of the stamp body A in the pocket 6, and at the same time discriminates the type of the mounted stamp body A. The stamp body A includes various types having respective different shapes, e.g. ones for a square stamp, a personal name stamp, a business stamp, an address stamp, etc. The different types of stamp bodies A for respective types of stamps are identical in length, but different in width and thickness. It should be noted that the above "length" means a size of the stamp body A between the stamp surface Ad and a surface on an opposite side thereto (back surface Ag), the above "width" means a size of the stamp body A between surfaces of opposite lateral ends thereof in its position mounted in the pocket 6, and the above "thickness" means a size of the stamp body between an upper side surface and a lower side surface of the stamp body in its position mounted in the pocket 6. To set each of these various types of the stamp body A different in width and thickness to a fixed position with respect to the directions along the width and the thickness of the stamp body A, in the present embodiment, as shown in FIGS. 6 and 7A to 7D, four bosses 251, 251, 251, 251, long and short, are provided on the bottom 6*b* of the pocket 6 such that they extend perpendicularly upward from the bottom, and the stamp body A is formed with fitting holes Af for fitting corresponding ones of the bosses therein, respectively.

Figure 7A:
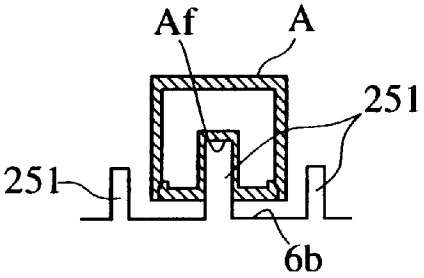
Figure 7B:
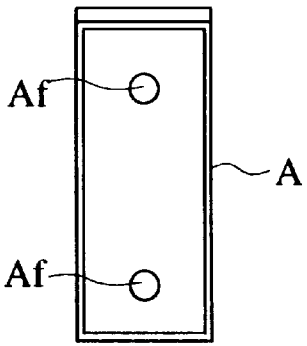
Figure 7C:
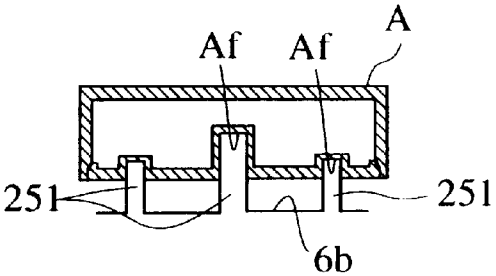
Figure 7D:
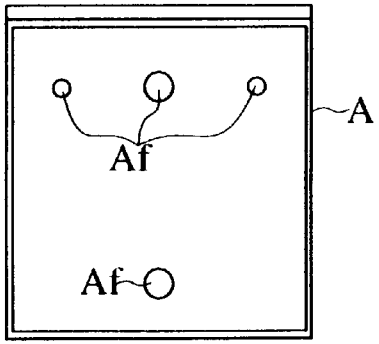
Figure 8A:
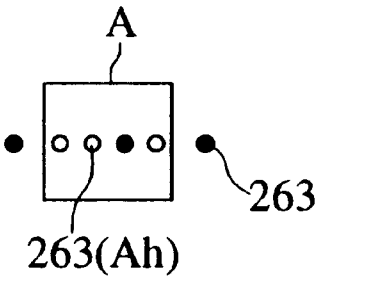
FIG. 8A is a diagram showing a pattern for discriminating a stamp body of a small square stamp.
Figure 8B:
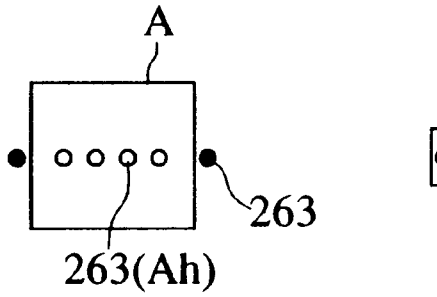
FIG. 8B is a diagram showing a pattern for discriminating a stamp body of a large square stamp.
Figure 8C:
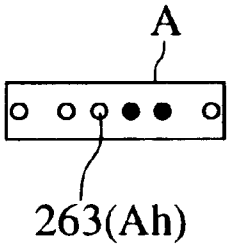
FIG. 8C is a diagram showing a pattern for discriminating a stamp body of a personal name stamp.
Figure 8D:
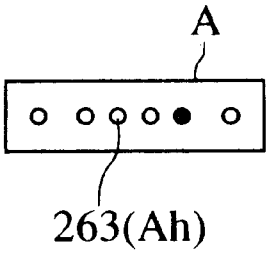
FIG. 8D is a diagram showing a pattern for discriminating a stamp body of a small business stamp.
Figure 8E:
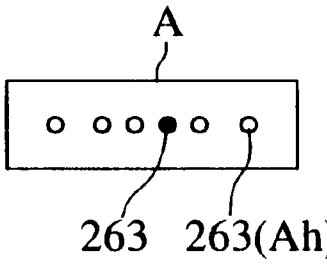
FIG. 8E is a diagram showing a pattern for discriminating a stamp body of a large business stamp.
Figure 8F:
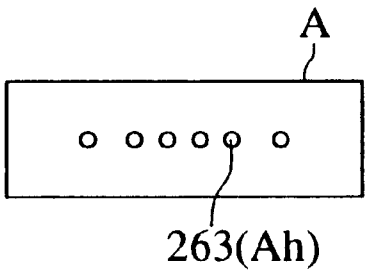
FIG. 8F is a diagram showing a pattern for discriminating a stamp body of an address stamp.
Figure 8G:
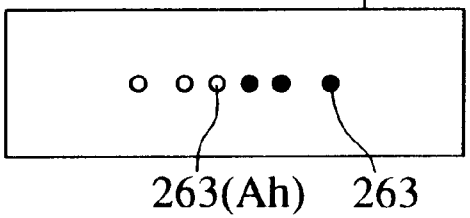
FIG. 8G is a diagram showing a pattern for discriminating a maximum size stamp body.

The four bosses 251, 251, 251, 251 are arranged to form a T shape, and in a manner corresponding thereto, a stamp body A for the square stamp, for example, is formed with two fitting holes Af, Af (see FIGS. 7A and 7B), and a stamp body A for the business stamp, for example, is formed with four fitting holes Af, Af, Af, Af (see FIGS. 7C and 7D). The number of the fitting holes Af and the depth of each of them depend on the type of the stamp body A, and this combination of the fitting holes Ag and the bosses 251 enables each stamp body A to be mounted in the pocket 6 such that the center of the stamp surface Ad of the stamp body A mounted in the pocket 6 is positioned to a fixed location.

Further, the back surface Ag on the opposite side to the stamp surface Ad is formed with a plurality of small holes Ah (type-detecting holes) arranged side by side at respective central locations along the width of the stamp body A. The small holes Ah cooperate with a switch array 262 of the stamp-detecting block 66, described hereinafter, to detect the type of the stamp body A (see FIGS. 8A to 8G). The stamp character label Bd of the plate-making sheet B printed with stamp characters and delivered to the outside of the apparatus separately from the ink ribbon C is affixed to the back surface Ag of the stamp body A, whereby the small holes Ah are concealed.

Figure 9:
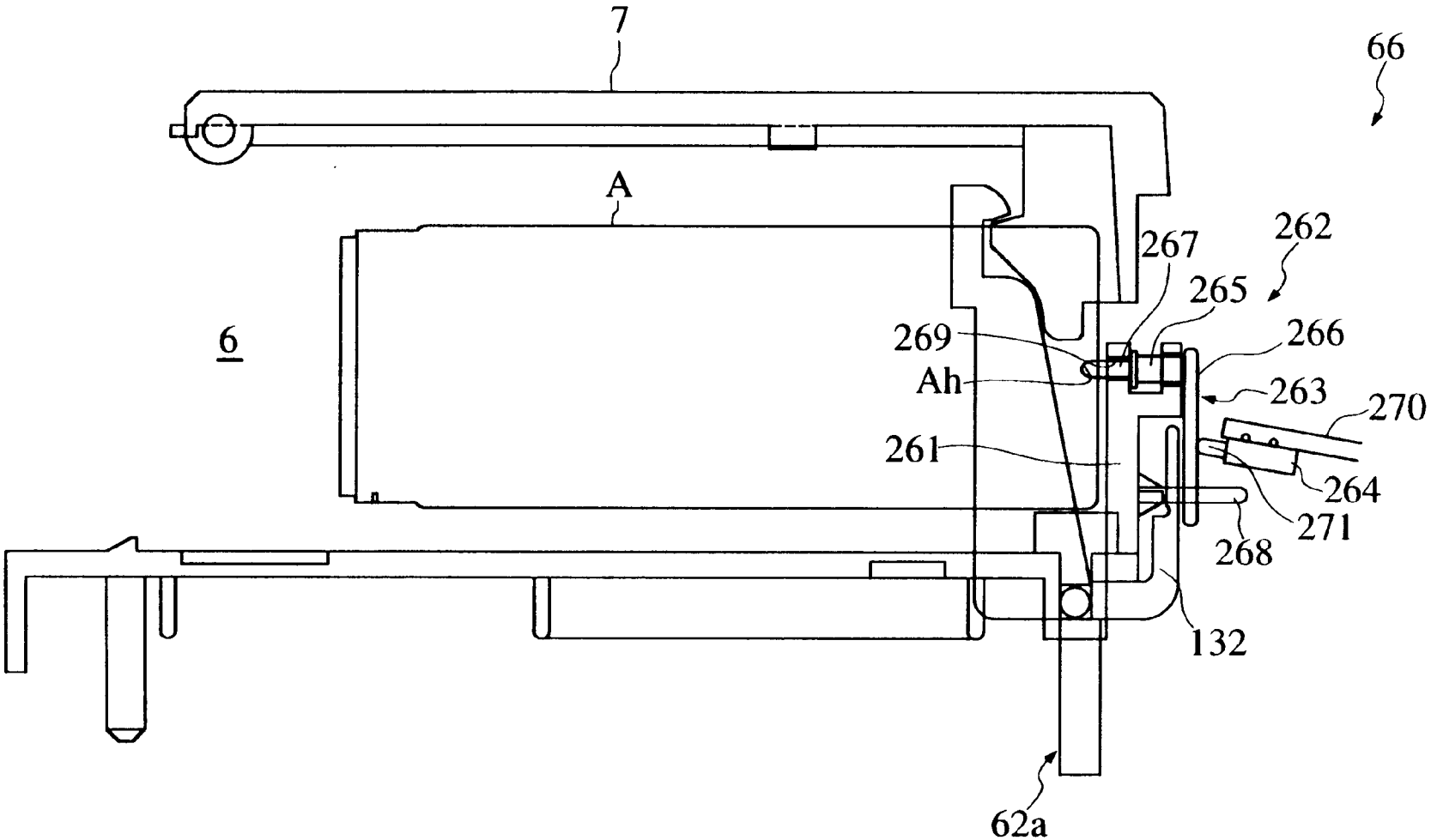
FIG. 9 is a cross-sectional view which is useful in explaining operations of a stamp-detecting block for detecting a stamp body.
Figure 10:
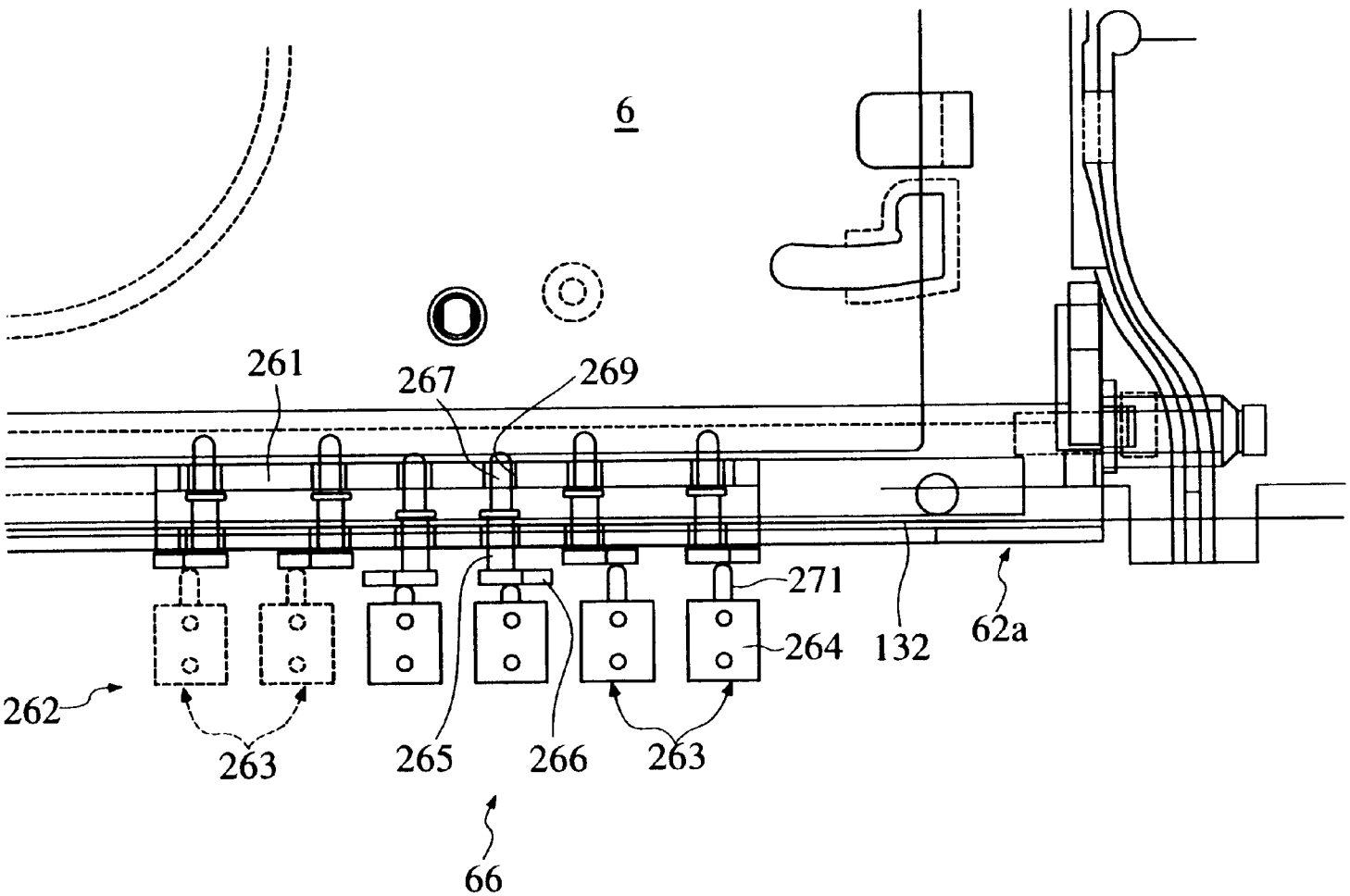
FIG. 10 is a partial plan view showing the pocket, the stamp-detecting block, and component parts associated therewith.

As shown in FIGS. 9 and 10, the stamp-detecting block 66 includes a switch holder 261 (also serving as a wall of the pocket 6) arranged such that it is opposed to the back surface Ag of the stamp body A when it is mounted in the pocket 6, and the switch array 262 formed of six detecting switches 263 supported on the switch holder 261. Each detecting switch 263 is comprised of a switch body 264 formed e.g. of a push switch, and a switch top 265 having one end for being projected into the pocket 6. The switch top 265 includes a plate portion 266 and a detecting projection 267 (including the one end) extending at a right angle to the plate portion 266, with a lower part of the plate portion 266 being guided by a guide projection 268 formed in the switch holder 261 and the detecting projection 267 being guided by a guide hole 269 formed through the switch holder 261 for forward and backward motions thereof.

The switch body 264 is fixed to the reverse side surface of a base plate 270 such that a plunger 271 thereof abuts the plate portion 266 of the switch top 265. The plunger 271 urges the switch top 265 toward the pocket 6 by the urging force generated by its spring, not shown. A state of the one end of the detecting projection 267 projected into the pocket 6 via the guide hole 269 through the switch holder 261, and a state of the same being retracted against the urging force of the plunger 271 correspond to ON-OFF states of the detecting switch 263, respectively. Actually, when any of the detecting switches 263 of the switch array 262 is turned on, mounting of the stamp body A is detected, whereas when all of the detecting switches 263 are turned off, removal of the stamp body A is detected. The detecting switches 263 of the switch array 262 are each in ON or OFF state depending on whether a corresponding small hole Ah exists in the stamp body A. Therefore, the type of the stamp body A can be determined from a pattern of ON/OFF states of the six detecting switches 263.

FIGS. 8A to 8G show the relationship between small holes Ah in the stamp body A and the six detecting switches 263 (detecting projections 267). Provision of the six detecting switches 263 for detecting presence or absence of the small holes Ah makes it possible to detect $2^6-1$, i.e. 63 types of patterns. A stamp body A for a square stamp or the like, which is small in width, has no small holes Ah corresponding to two outermost detecting switches 263, 263 on respective opposite sides, and the two detecting switches 263, 263 project into space at opposite locations outside the stamp body A. That is, a stamp body A having a small width, such as a stamp body A for a square stamp, is recognized by a pattern for a stamp body A having imaginary small holes Ah at outermost locations thereof.

Next, the control block 300 will be described with reference to FIG. 11. The control block 300 is formed e.g. by a microcomputer, and includes a CPU 301, a ROM 302, an input interface 304, an output interface 305, and a system bus 306 connecting all these devices to each other.

The ROM 302 stores various programs, dictionary data for kana-kanji character conversion, font data of characters, symbols, etc. and fixed data, such as data of a predetermined stamp frame. The RAM 303 is used as a working area, and also as means for storing fixed data input by a user. The data stored in the RAM 303 is backed-up even when the power is turned off.

The input interface 304 interfaces to take in signals from the function switch 8, the push button group 22 and the operating dial 23 of the operating block 21, the head surface temperature sensor 56*b* and an optical sensor 183, referred to hereinafter, of the printing block 64, the ambient temperature sensor 67 of the exposure block 65, and the stamp-detecting block 66, via the system bus 306 into the CPU 301 or the RAM. The output interface 305 interfaces to deliver control signals and data for use in control operations, which are received via the system bus 306 from the CPU 301, the ROM 302, and the RAM 303, to the light-emitting elements 12, a beeper 333, the display-driving circuit 24*a* of the operating block 21, the head-driving circuit 56*a* of the printing block 64, the motor-driving circuit 57*a*, the light source-driving circuit 191*a* of the exposure block 65, etc.

The CPU 301 carries out processing based on input signals from the input interface 304, and a processing program stored within the ROM 302 and selected according to the processing on each occasion, using the RAM 303 as the working area, and fixed data stored within the ROM 302 and the RAM 303, as needed.

Figure 12:
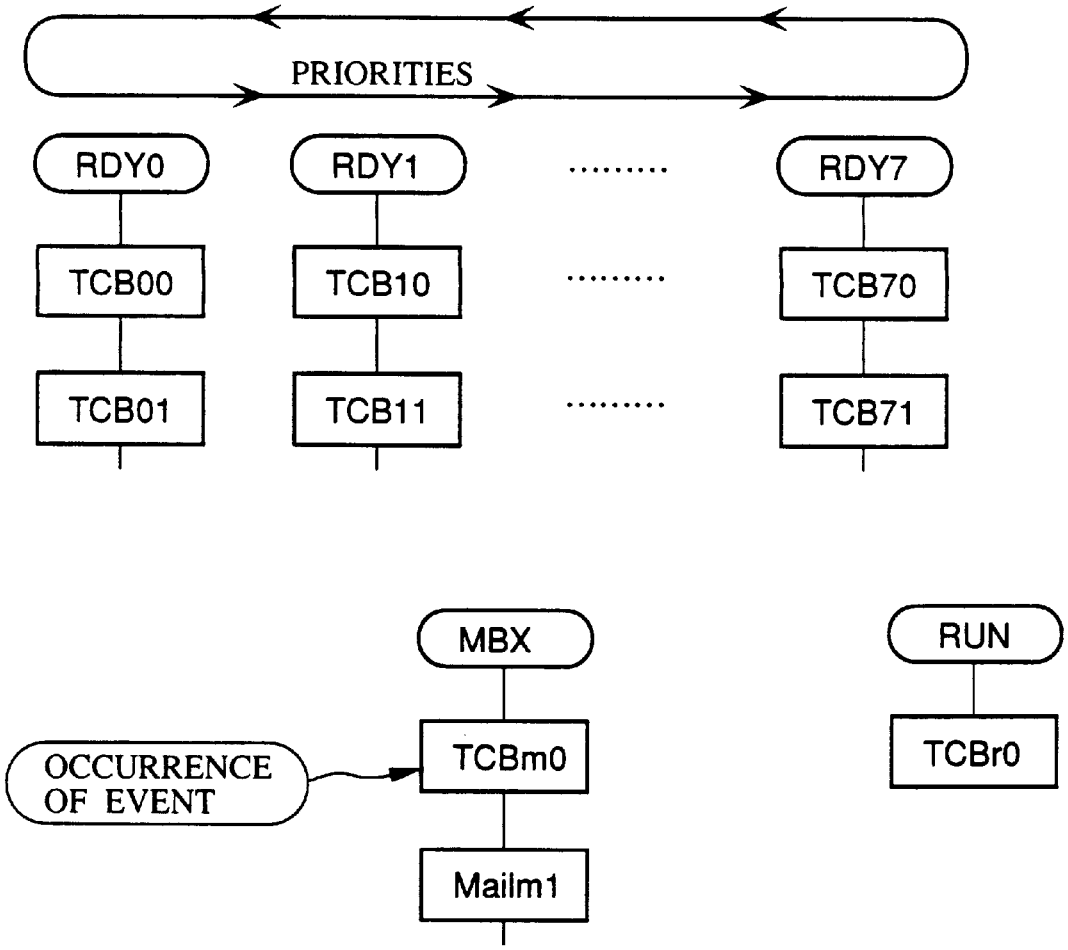
FIG. 12 is a conceptual representation of an outline of multitasking by the stamp-making apparatus.

The stamp-making apparatus 1 of the present embodiment carries out multitask processing in the following manner:

FIG. 12 shows a conceptual representation of the multitasking of the present embodiment. A plurality of tasks to be executed are classified into groups having respective priorities RDY0 to RDYn (in the case of the illustrated example, n=7), and the order of processing of tasks is determined based on the priorities to thereby activates each task. In the following description, tasks assigned the highest priority RDY0 are designated as TCBOi (i=0, 1, 2, . . . ), and tasks assigned the lowest priority are designated as TCB7i. In general, a task assigned the priority RDYj (j=0 to 7) is designated as TCBji. Further, when a task is classified into a group having the priority RDYj, and placed in a wait state in this group, i.e. in the priority, this state will be described e.g. as "a task TCBm0 is registered as TCBj0". When one or more tasks assigned the priority RDYj are registered, it will be expressed as "task existing in RDYj".

Further, as shown in FIG. 12, in the multitasking, an area is set aside for registering a name of each task (e.g. TCBm0 shown in the figure) created for execution in response to an event, such as an interrupt, generated e.g. by depression of any of the push buttons of the push button group 22 or operation of the operating dial 23, and registering a communication task between tasks (e.g. Mailm1 shown in the figure; hereinafter simply referred to as a "mail"). This area will be referred to as "mail box MBX" in the following description. Further, the name of a task representative of the contents of current or actual processing is expressed as TCBr0, and execution of this task for processing is expressed as "the active task run processing", or "the RUN processing" in an abbreviated form. For example, when a task TCB00 is selected and activated, it will be expressed as "the task TCB00 is registered as TCBr0 and activated". This registration is shown as "TCBr0←TCB00" in hierarchical operation diagrams, referred to hereinafter, and flowcharts. The task TCBm0 in the mailbox MBX contains information concerning whether the task TCBr0 currently being executed should be forcedly interrupted or not, and which priority RDYi it should be registered in, and in MBX processing, referred to hereinafter, the task TCBm0 is executed according to these pieces of information.

Figure 13:
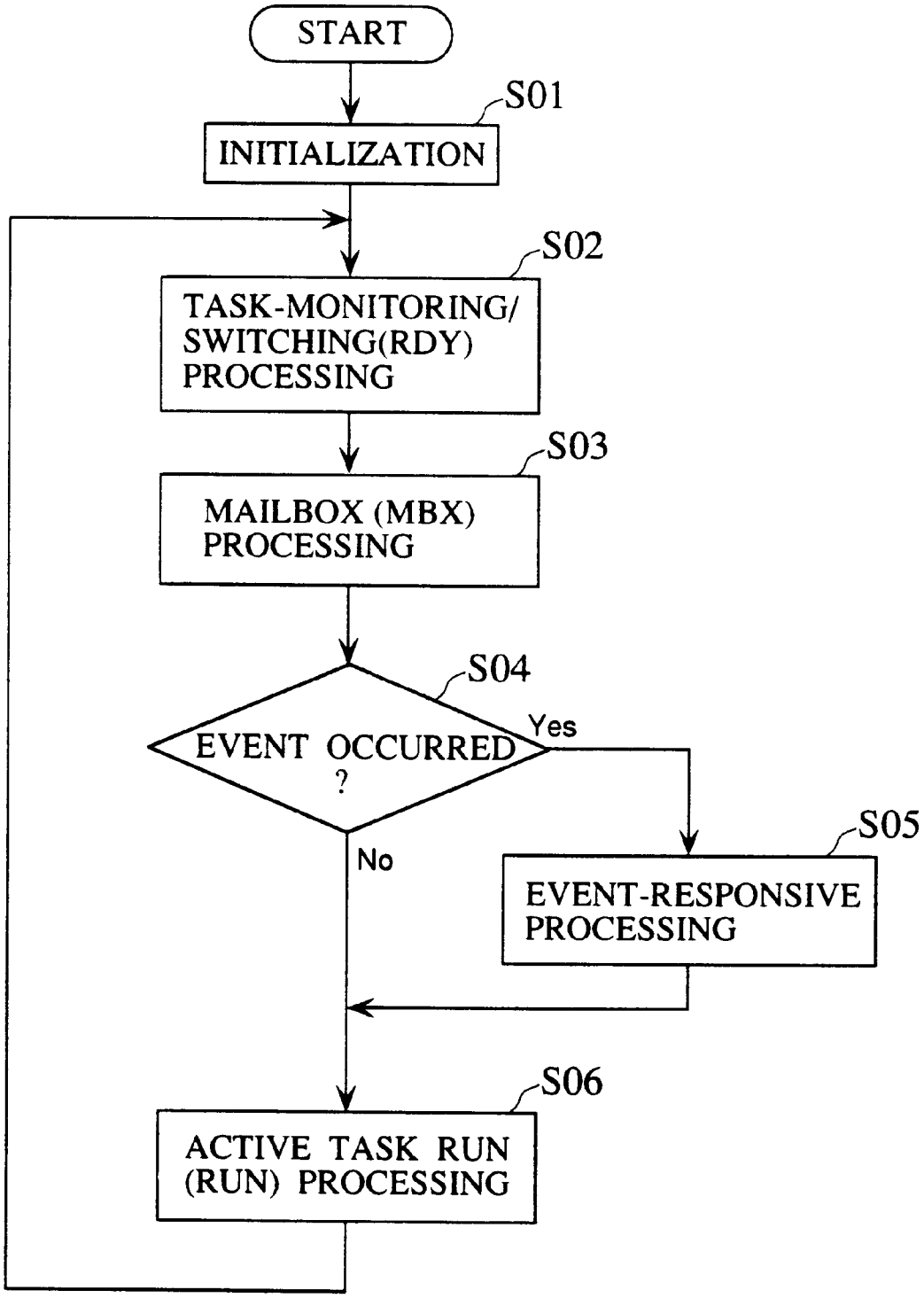
FIG. 13 is a flowchart showing an outline of the overall processing of the stamp-making apparatus.

FIG. 13 shows a procedure of processing executed according to the stamp-making method of the present embodiment, expressed in the form of an ordinary flowchart. As shown in the figure, when the power is turned on to start the processing, first an initialization of each device of the stamp-making apparatus is executed at a step S01, task-monitoring/switching (RDY) processing at a step S02, and mailbox (MBX) processing at a step S03. Then, it is determined at a step S04 whether or not any event has occurred. If an event has occurred, event-responsive processing is executed at a step S05, and thereafter, the active task run (RUN) processing is executed at a step S06. Then, the RDY processing (the step S02) to the RUN processing (the step S06) are repeatedly executed.

However, in the actual processing, the RDY processing and the MBX processing are executed only at predetermined regular timing, but event-responsive processing is started upon occurrence of the event, while the RUN processing is executed during execution of the other processing. Therefore, the present multitasking cannot be expressed accurate enough by the above flowchart, and the hierarchical structure of the program is difficult to understand therefrom. Therefore, in the following description, when a sequence of steps of a task is described, a flowchart is employed which shows a task actually executed by activating another task for the multitasking is shown as a subroutine. Event-driven type tasks, i.e. tasks which are initiated or activated in response to respective events, are described by a description method used in a diagram of FIG. 14 (hereinafter referred to as "the hierarchical operation diagram").

Figure 14:
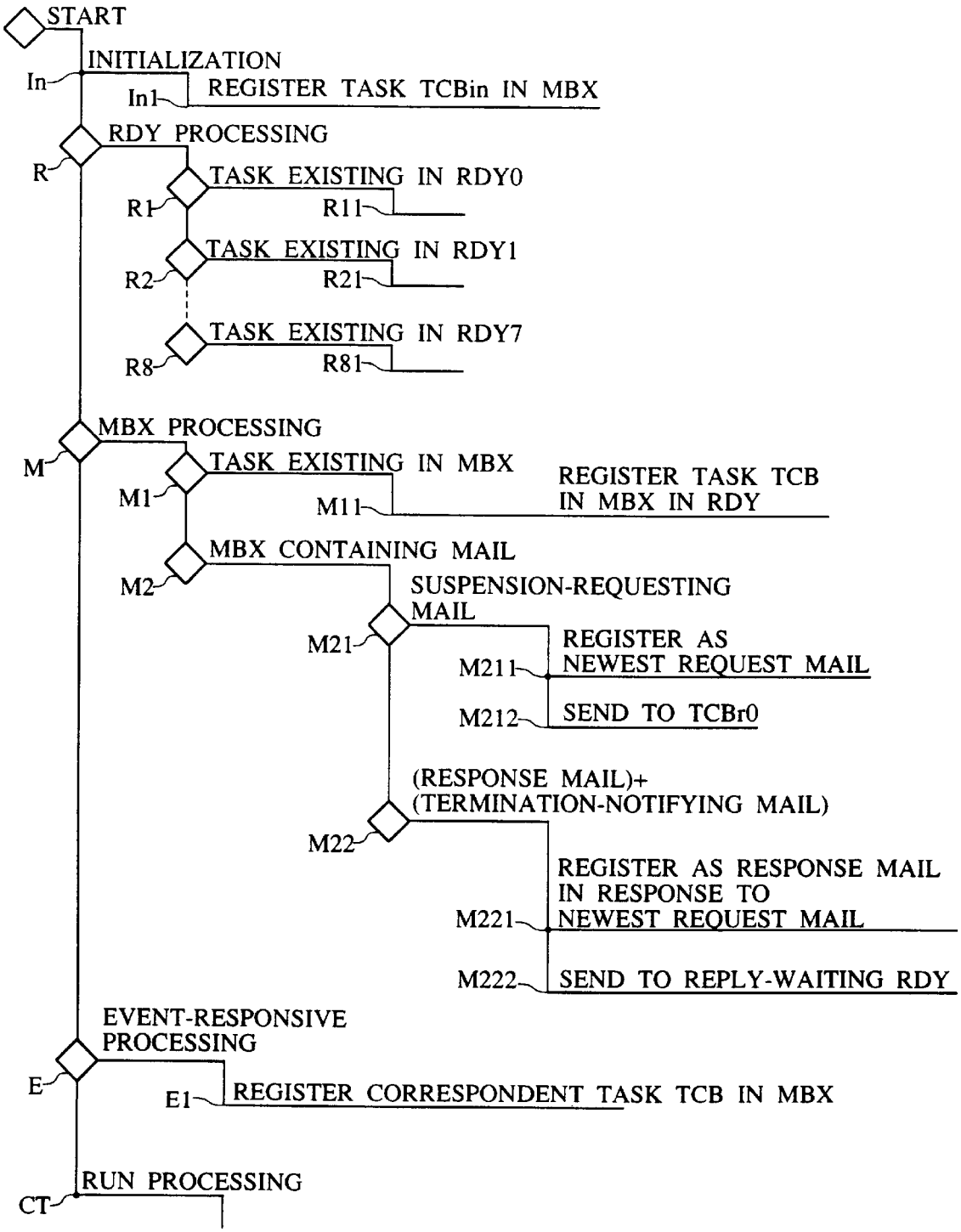
FIG. 14 is a hierarchical operation diagram showing main tasks carried out by the stamp-making apparatus.

In the hierarchical operation diagram, each processing branch point designated by symbol ◇ shows a task, a program, or a subroutine, which is of an event-driven type i.e. executed when an event, such as an interrupt or activation of a task by another task, has occurred. The task-monitoring/switching (RDY) processing shown in FIG. 14 is started only when an interrupt is generated at regular time intervals e.g. through a real time monitoring. Further, the mailbox (MBX) processing is also started by an interrupt generated at regular time intervals other than the regular time intervals of the PDY processing. The event-responsive processing registers various events, such as tasks initiated by operations of the operating dial 23, in the mailbox MBX. Although only one routine is shown in FIG. 14 as a representative, actually, the mailbox MBX is accessed for registration of the name of a task to be executed in response to each event independently whenever the event occurs.

As shown in FIG. 14, when the program is started by turning on the power, first, the initialization at a processing branch point In (hereinafter referred to as "the initialization (In)") is executed. The initialization (In) registers a task TCBin of main tasks-starting processing in the mailbox MBX (In1). When the initialization (In) is terminated, if it is neither time for the RDY processing nor time for the MBX processing, or any other event has not occurred, then the program proceeds to the RUN processing (CT). However, at this time point of the present case, there is no task registered, so that time for starting the RDY processing or the MBX processing is awaited.

In this state, when it becomes time for the RDY processing, the RDY processing (R) is executed, but there are no tasks registered in the priorities RDY0 to RDY7, i.e. no tasks exist in the priorities RDY0 to RDY7 (R1 to R8), so that the RDY processing is terminated without executing any specific processing. On the other hand, when it is time for the MBX processing, the MBX processing (M) is executed, and according to the task TCBin for starting main tasks, which has been registered as TCBm0 in the mailbox MBX, the processing of "task existing in MBX (M1)" is executed to register the task TCB of the mailbox MBX in the priority RDY. That is, if the priority specified for the task TCBin corresponds to the priority RDY4, the task TCBin is registered as TCB40 in the priority RDY4.

Figure 15:
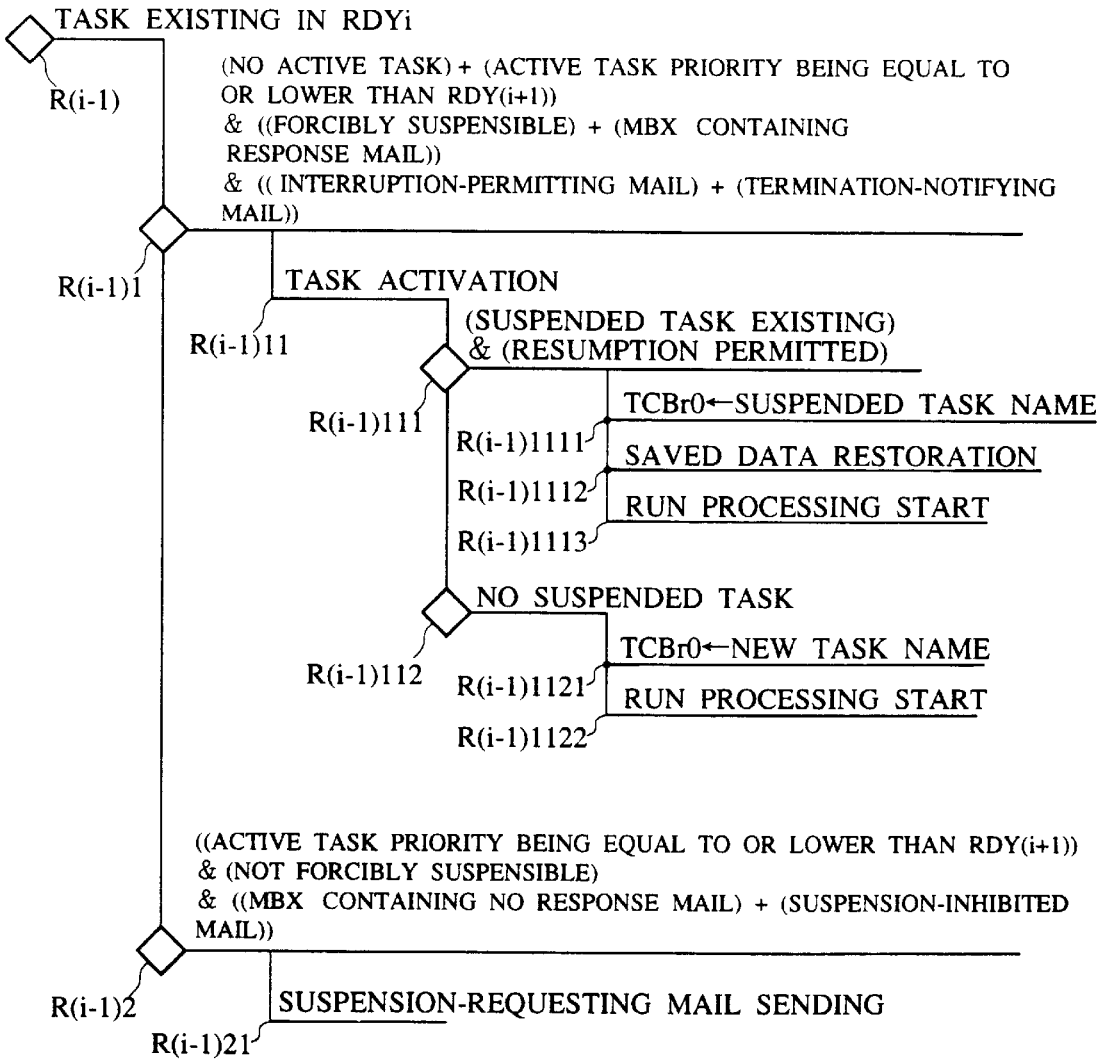
FIG. 15 is a hierarchical operation diagram of task-monitoring/switching processing executed by the stamp-making apparatus.

In this state, when it is time for the RDY processing, the RDY processing (R), e.g. the processing of "task existing in RDY4 (R3)" is executed. Now, the processing of "task existing in RDYi (R(i−1))" will be described with reference to FIG. 15. This processing largely branches into a case of activating a new task (or a suspended task), a case of sending a suspension-requesting mail to the active task, a case of executing no processing.

First, if there is no active task, i.e. if there is no task registered as TCBr0, and hence the RUN processing is not being executed, or if the active task TCBr0 has a priority equal to or lower than the priority RDY(i+1), and at the same time, the active task is suspensible, another task is stated. The term "suspensible" means that the task to be activated can forcibly interrupt execution of the active task, or that a response mail in response to the suspension-requesting mail is an interruption-permitting mail or a termination-notifying mail indicative of termination of the active task. Under the above-mentioned condition, i.e. when the conditions of (no active task)+(active task priority being equal to or lower than RDY(i+1)) & ((forcibly suspensible)+(MBX containing response mail) & ((interruption-permitting mail)+(termination-notifying mail)) are fulfilled at R(i−1)1, the new task starts to be activated at R(i−1)11. Here, "+" represents a logical sum, while "&" a logical product.

On the other hand, a suspension-requesting mail is sent to the mailbox MBX, if the priority of the active task is equal to or lower than RDY(i+1), and at the same time there is no response mail from the active task so that it is not known whether the active task is suspensible or not, or the situation requires resending of the suspension-requesting mail after a response mail saying that the active task is not suspensible was received in response to the preceding suspension-requesting mail. That is, if the conditions of (active task priority being equal to or lower than RDY(i+1) & (not forcibly suspensible) & ((MBX containing no response mail)+(suspension-inhibited mail)) are fulfilled at R(i−1)2, a suspension-requesting mail is sent at R(i−1)21. If neither of the above two sets of conditions are fulfilled, i.e. if the active task priority is equal to or higher than RDYi, no particular processing is executed, but the processing of "task existing in RDYi (R(i−1))" is terminated.

In the task activation (R(i-1)11), if there exists any other task which has been suspended to activate a task higher in priority, or to start a subtask and wait for results of processing by the subtask, it is determined e.g. from resumption information, referred to hereinafter, whether the suspended task can be resumed or not. If the suspended task can be resumed, the processing of (suspended task existing) & (resumption permitted) (R(i−1)111) is executed. In this processing, the suspended task is registered as the active task TCBr0 at R(i−1)111, and if there are any saved data or the like, these data are restored or returned at R(i−1)1112, followed by newly starting the RUN processing at R(i−1) 1113. According to generation of this event, task (CT1) is activated in the RUN processing (CT), referred to hereinafter.

When there is no suspended task, the processing of "no suspended task" is executed at R(i−1)112, and after the processing of "TCBr0←new task name" is executed at R(i−1)1112, the RUN processing is started again at R(i−1) 1122. For example, when the task TCBin for activating the main tasks is to be executed, in the processing of task activation (R311), the processing of "TCBr0←TCBin (R31121)" is executed in "no suspended task (R3112)", and then the RUN processing is started at R31122.

On the other hand, if there is a suspended task but the resumption of the suspended task is inhibited, the permission of resuming the suspended work has to be awaited, so that the task activation (R(i−1)11) is terminated without executing any processing. It should be noted that since the above-mentioned subtask is normally set to a higher priority than the originating task, generally, the subtask has already been terminated, permitting the originating task to be resumed when the task initiation (R(i−1) 11) is processed.

Next, the mailbox (MBX) processing will be described with reference to FIG. 14. In this processing, in the case of "task existing in MBX (M1)", the task TCBm0 in the mailbox MBX is registered at M11 in a priority RDYj according to a priority specified for the task. In the case of "MBX containing mail (M2)", if the mail is a suspension-requesting mail (M21), it is registered as a newest request mail at M211, and sent to the active task TCBr0 at M212, whereas if the mail fulfills the conditions of "(response mail)+(termination-notifying mail)" at M22, it is registered as a response mail in response to the newest request mail (at M221) and sent to a reply-waiting RDY (at M222).

Next, the event-responsive processing (E) will be described. Although the initialization (In) is described as a different kind of processing from this processing for the convenience of explanation, it is actually a kind of event-responsive processing (E). That is, the event-responsive processing (E) registers a task created by an event from the outside of the CPU, such as a manipulation of the operating dial 23, or a task created for execution of a program for internal processing, in the mailbox MBX at E1. For example, after registration in the mailbox MBX, the task TCBin for starting the main tasks is registered in the priority RDY, and then executed as a new task by the (RUN) processing described below.

Figure 16:
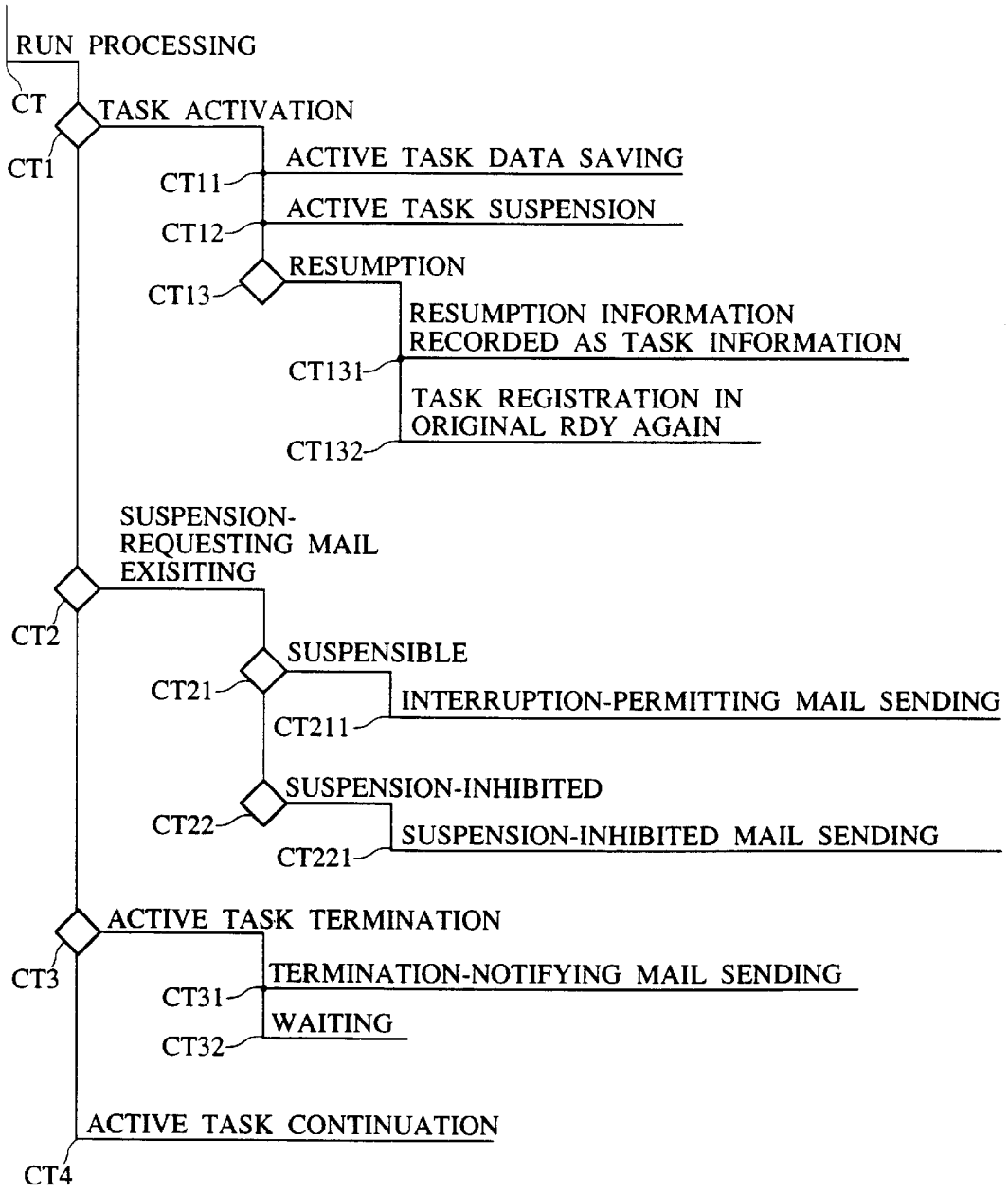
FIG. 16 is a hierarchical operation diagram of active task-executing processing executed by the stamp-making apparatus.

Now, the active task run (RUN) processing (CT) will be described with reference to FIG. 16. This processing continues the active task TCBr0 when there is no other event generated as described above. During this processing, there occur events of "task activation (CT1)", "suspension-requesting mail existing (CT2)" and "active task termination (CT3)". If these events do not occur, the processing of the active task is continued at CT4. If another task is to be activated at CT1, data of the active task being executed is saved at CT11, and then the active task is suspended at CT12. If resumption of the task is expected at CT13, resumption information is recorded as task information at CT131, based on which the task is registered again in the original priority RDY at CT132.

When the suspension-requesting mail existing at CT2, it is determined whether or not the active task is in a suspensible state. If the active task is suspensible at CT21, an interruption-permitting mail is sent to the mailbox MBX at CT211, while if it is not suspensible at CT22, a suspension-inhibited mail is sent at CT221. It should be noted that although similar processing is executed to temporarily suspend the RUN processing, when the RUN processing (CT) being executed is switched to the RDY processing (R), the MBX processing (M) or the event-responsive processing (E), this processing is a basic routine for real-time monitoring which is different from the processing of switching to the other tasks, and hence description thereof is omitted. When the active task TCBr is terminated at CT3, the termination-notifying mail is transmitted to the mailbox at MBX CT31, and the following task activation is awaited at CT32.

Figure 17:
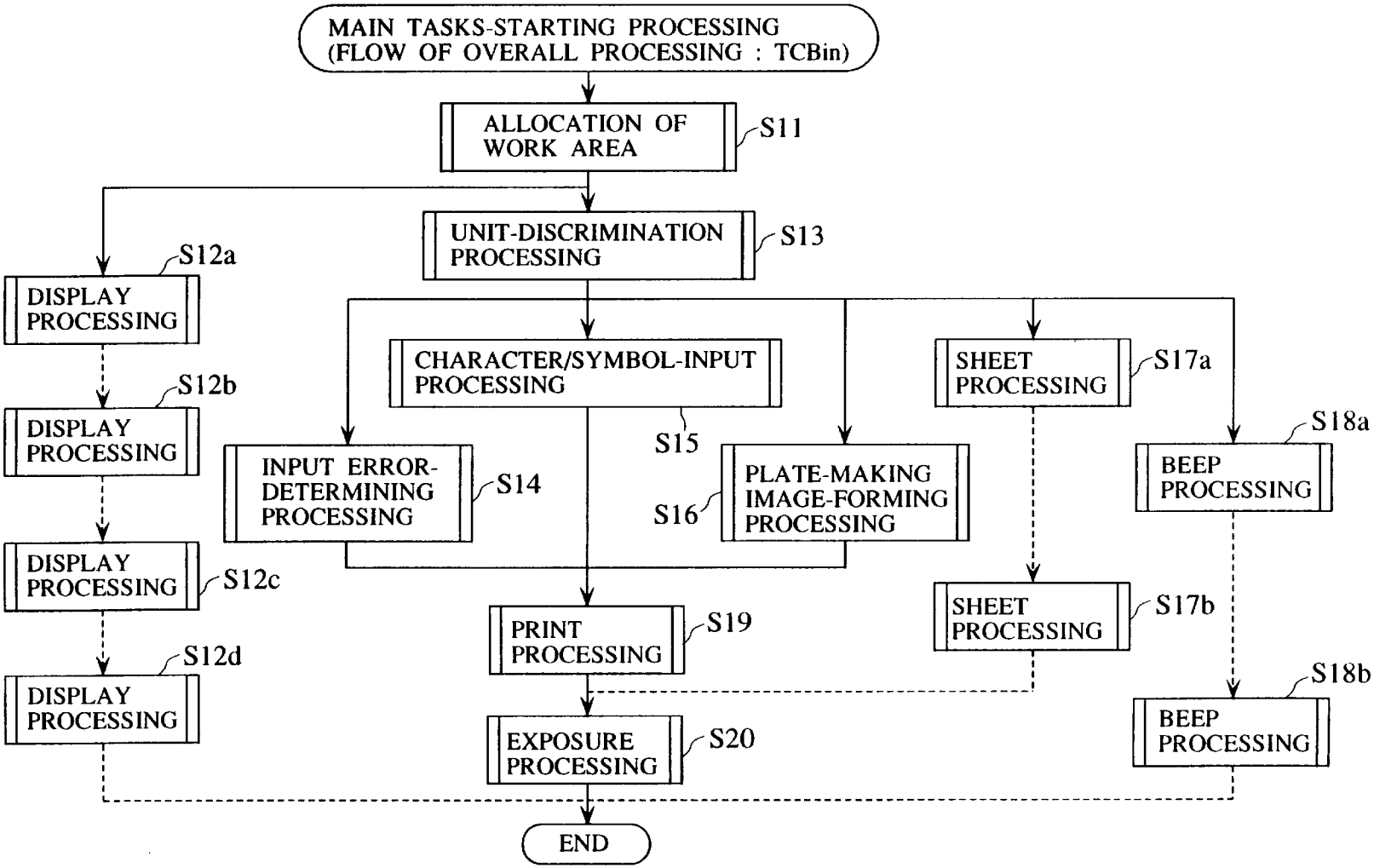
FIG. 17 is a flowchart of an example of main tasks-starting processing executed by the stamp-making apparatus.

FIG. 17 shows an example of the main tasks-starting processing. As shown in the figure, when the main tasks-starting processing task TCBin is activated, first, a task of allocating work area is registered in the mailbox MBX at a step S11, and then a task of display processing and a task of unit (stamp body)-discriminating processing are registered in the mailbox MBX at respective steps S12 and S13. Then, a task of input error-determining processing is registered at a step S14, a task of character/symbol-input processing at a step S15, a task of plate-making image (stamp image)-forming processing at a step S16, a task of sheet processing at a step S17, and a task of buzzer processing at a step S18. Then, after a task of print processing is registered at a step S19, a task of exposure processing is registered at a step S20. The MBX processing classifies these subtasks according to the order of priority and registers each of them in a proper priority RDYj, and then the RDY processing causes them to be activated one after another. Further, after these subtasks are started, subtasks of the subtasks are registered in the mailbox MBX as required and each of them is activated by the RDY processing.

That is, a plurality of tasks including the task TCBin of the initialization continue to be executed until they are each eventually delayed or placed in a wait state. The internal processing of the stamp-making apparatus 1 proceeds to a next step by the multitasking described above when another task as a cause of the wait state of a task has progressed to be deactivated, so that eventually, the internal processing of the multitasking enters a state in which an entry or other operation by the user is awaited. Conversely, once the user operates, the tasks therefor including error handling tasks are sequentially carried out, and eventually the program enters a state in which another operation by the user is awaited.

Therefore, the user actually feels that various processing operations or tasks are executed in parallel and simultaneously. That is, according to the processing of the present stamp-making apparatus 1, compared with a manner of processing in which the processing proceeds to a next step each time only in response to an operation by the user, various kinds of processing operations which will be required to be executed later can be executed in advance, whereby a time period during which the man or user has to wait can be minimized, enabling high-speed processing to be attained. It should be noted that parallel processing, such as the multitasking processing described above, can be realized by forming the program or all the tasks described above by interrupt handlers and employing an interrupt control circuit which controls the order of priority of interrupts generated.

The dotted lines appearing in FIG. 17 show that tasks appear to be simultaneously executed in parallel with each other. Further, the task of character/symbol-input processing (step S15),the task of input error-determining processing (step S14), and the task of plate-making image-forming processing (step S16) are simultaneously executed. More specifically, after a first entry of characters or the like (letters, symbols, figures, or the like) is effected, and before the following entry of characters or the like is effected (step S15), it is determined at the step S14 whether or not there is an inconvenience in the number of characters entered in a text, and an image for use in the plate-making is formed at the step S16. In the course of executing these steps, if a character entry is carried out at the step S15, the task of the input error-determining processing (S14) and that of the plate-making image-forming processing (step S16) are immediately stopped, and then resumed from the start thereof. In the meanwhile, the display processing (step S12, shown as S12*a* to S12*d*) and the buzzer processing (step S18, shown as S18*a* and S18*b*), further, the sheet processing (step S17, shown as S17*a* and S17*b*) responsive to insertion of the plate-making sheet, are being executed in parallel with the above steps.

In the case of the stamp-making apparatus 1, the printing apparatus of the present invention is essentially implemented by the control block 300, the beeper 333, and the printing block 64. Features of operations executed by the stamp-making apparatus 1 will be described with reference to FIGS. 18 to 22C.

As shown in FIG. 4, the plate-making sheet B is a laminate of the base sheet Ba and the adhesive sheet Bb, generally in the form of a strip. The adhesive sheet Bb is formed with cutting lines Bc (e.g. scored) defining a rectangular area. The rectangular area of the adhesive sheet Bb is peeled off the base sheet Ba along the cutting lines Bc to form the stamp character label Bd to be affixed to the back of the stamp. There are provided detecting holes (marks for detection) Be, in the vicinity of an upper side edge and a lower side edge of the plate-making sheet B (or more specifically, an upper right corner and a lower left corner of the same), as viewed in FIG. 4, at respective centrosymmetric locations with respect to the center of the same. Since both ends are formed exactly alike, the plate-making sheet B can be inserted into the apparatus 1 with either end positioned forward, which makes it easy for the user to handle the same.

Figure 20:
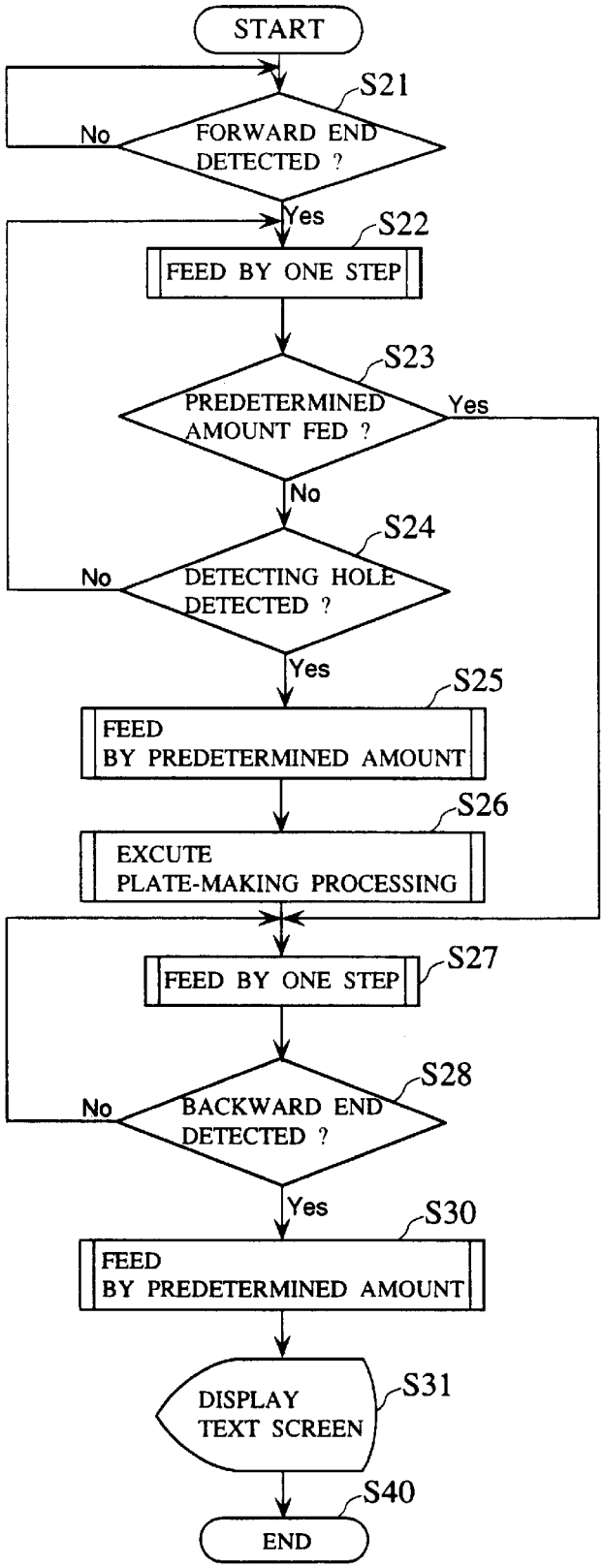
FIG. 20 is a flowchart of an example of a processing procedure from the insertion of the plate-making sheet to the discharge of the same.

Next, operations for insertion and discharge of the plate-making sheet B will be described with reference to FIGS. 18 to 20. FIG. 18 provides a sequence of positions of a plate-making sheet in the printing block from insertion of the plate-making sheet to discharge of the same together with operations of the optical sensor and the platen roller, and steps of processing, in a tabular form. FIG. 20 shows an example of a procedure of processing from insertion of the plate-making sheet B to discharge of the same. In the following description, SNn (n=1 to 9) designates each state number appearing in FIG. 18, and Sxx designates each step number of steps appearing in FIG. 20.

First, when the plate-making sheet B is inserted into the feeding passage 181 from the inserting slot 9*a,* a forward end thereof is detected by the optical sensor 183 (SN1 and S21). In response to a detection signal delivered by the optical sensor 183, the platen roller 57 starts to be driven for rotation by a motor to roll out the ink ribbon C from the supply reel 14. At the same time, the platen roller 57 pulls in the plate-making sheet B between the print head 56 and itself to thereby bring a portion of the ink ribbon C and a portion of the plate-making sheet B, one upon the other, onto the print head 56, and further feeds the plate-making sheet B together with the ink ribbon C by a certain amount (predetermined amount assigned to the forward end of the plate-making sheet B) (SN2 and S22 to S24).

Since the plate-making apparatus 1 feeds the plate-making sheet B and the ink ribbon C simultaneously as described above, the certain amount, i.e. the predetermined amount assigned to the forward end of the plate-making sheet B is set such that it is equal to an amount of feed of the ribbon tape in a range of 1 to 10 seconds in terms of time over which feeding is effected, so as to minimize consumption of the ink ribbon C. In addition to reduction of consumption of the ink ribbon C, this makes it possible to detect an abnormal insertion of the plate-making sheet B, described hereinafter, at an early stage, thereby causing the user to feel at ease in operating the apparatus 1, and at the same time to deal with the abnormality promptly.

Next, it is determined at a step S23 whether or not the apparatus 1 has fed the plate-making sheet B by the predetermined amount assigned to the forward end of the plate-making sheet B. If the answer to the question of the step S23 is negative (NO), it is determined at a step S24 whether or not the detecting hole Be of the plate-making sheet B was detected by the optical sensor 183. If the answer to the question of the step S24 is affirmative (YES), i.e. if the detecting hole Be was detected (SN3), the apparatus 1 further feeds the plate-making sheet B by a certain amount (predetermined amount for locating the start of an image-forming area of the plate-making surface of the plate-making sheet B) from a position of the plate-making sheet B where the detecting hole Be was detected, to thereby locate the start of the image-forming area of the plate-making surface of the plate-making sheet B (S25). Then, when the start of the image-forming area has been located, the feeding of the plate-making sheet B by the platen roller 57 is suspended (SN4).

As described in FIGS. 12 to 17, the operation of inserting a plate-making sheet B is always permitted unless the apparatus 1 is in a specific state, e.g. an error. That is, even during execution of another operation, when a plate-making sheet B is inserted into the inserting slot 9*a,* it is always received, and the start of an image-forming area of a plate-making surface thereof is located to set the plate-making sheet on standby for being printed. Therefore, the user can feel at ease in operating the apparatus 1.

Further, the predetermined amount of the plate-making sheet B to be fed for locating the start of the image-forming area is adjustable. This adjustment for positioning the plate-making sheet is carried out by environment-setting processing activated as a subtask of the unit-discriminating processing (S13) in FIG. 17, and an actual movement or feed of the plate-making sheet B is effected at in step S17*a* for positioning or locating the start of the image-forming area.

This task of environment-setting processing is activated by depressing a predetermined push button of the bush button group 22. In the processing, first, one of the options belonging to Level 1 shown in FIG. 19 is displayed on the display 24. The contents of display can be switched to another by operating the operating dial 23. In setting a position of the start of an image-forming area of a plate-making surface of a plate-making sheet B, the user operates the operating dial 23 to display "POSITION", and then pushes the execution key 31 of the operating dial 23 to select the option, i.e. settle the selection. Whenever the option, in the present case "POSITION", is selected from Level 1, one of options at Level 2 under the selected option shown in FIG. 19 is displayed on the display 24. In the case of "POSITION" having been selected from Level 1, one of fifteen levels for positioning adjustment ranging from "PRO 7" to "RETRO 7" is displayed. The user can select a desired one out of the fifteen levels in the same manner as at Level 1.

When these selections are completed, the present processing is terminated by pushing the predetermined push button of the push button group 22. Data of these selections is stored, even after completion of the environment-setting processing, until the apparatus 1 is reset or configured again. Thus, the location of the start of the image-forming area of the plate-making surface of the plate-making sheet B, can be adjusted, whereby it is possible to compensate for or absorb variations among individual stamp-making apparatuses concerning mechanical accuracy of a mechanism of feeding a plate-making sheet B or the like, and at the same time shift the start of the image-forming area to a desired location on the plate-making surface of the plate-making sheet B.

Next, as shown in FIGS. 18 and 20, if printing is instructed after the start of the image-forming area on the plate-making sheet B is located (SN4 and S25), the apparatus 1 executes printing (plate making) at a step S26 (SN5 to 6) based on print data, while feeding the plate-making sheet B by the platen roller 57. When the printing is completed, the plate-making sheet B is further fed by a certain amount (predetermined amount to be fed after completion of the printing) at a step S27 (SN7). Meanwhile, it is determined at a step S28 (SN8) whether or not a backward end of the plate-making sheet B has been detected by the optical sensor 183. If the answer to the question of the step S28 is affirmative (YES), i.e. when the backward end of the plate-making sheet B has been detected, the plate-making sheet B is further fed by a certain amount (predetermined amount to be fed for discharge of the plate-making sheet B) from a position of the plate-making sheet B where the backward end was detected, to thereby discharge the same, and then the platen roller 57 is stopped from rotating at a step S30 (SN9). Then, at a step S31, a predetermined message, such as "PRINTING COMPLETED", is displayed on the display 24 (text screen), followed by terminating the whole processing concerning the plate-making sheet B at a step S40.

On the other hand, if the answer to the question of the step S23 is affirmative (YES), i.e. if the detecting hole Be cannot be detected during the feeding of the plate-making sheet B by the certain amount (predetermined amount assigned to the forward end) (SN2 correspond to steps S22 to 24), the feeding of the plate-making sheet B is continued at the step S27 until the answer to the question of the step S28 becomes affirmative (YES), i.e. until the backward end is detected. Then, if the backward end of the plate-making sheet B is detected (SN8), the plate-making sheet B is further fed by the certain amount (predetermined amount for discharge) from a position of the plate-making sheet B where the backward end was detected, to thereby discharge the same (SN9 and S30). Then, at the step S31, a predetermined message is displayed on the display 24, followed by terminating the program at the step S40.

As described above, in the case of the stamp-making apparatus 1, when the plate-making sheet B is set with a wrong-side for print, or when a plate-making sheet B of a non-conforming type has been inserted, the detecting hole (mark for detection) Be thereof is not detected by the optical sensor 183, so that the plate-making sheet B continues to be fed without executing printing. On the other hand, when the detecting hole Be is detected and the start of an image-forming area of the plate-making sheet B is located, the apparatus 1 executes printing based on print data in response to an instruction for printing, while feeding the plate-making sheet B. That is, with reference to the detecting hole Be detected by the optical sensor 183, it is possible to locate the start of the image-forming area by feeding the plate-making sheet B by a certain amount. Therefore, it is possible to print an image in a desired area on the plate-making surface of the plate-making sheet B by simple operations. At the same time, erroneous operations, such as insertion of a plate-making sheet B with a wrong-side for print, or insertion of a plate-making sheet B of a non-conforming type, can be easily detected, so that printing in an abnormal state can be avoided.

Further, in response to a detection signal delivered by the optical sensor 183, the apparatus 1 further feeds the plate-making sheet B by a predetermined amount from a position of the plate-making sheet B where the backward end thereof was detected by the optical sensor 183 to thereby discharges the plate-making sheet B. Therefore, irrespective of whether feeding of the plate-making sheet B is continued without printing due to occurrence of abnormality, e.g. when the detecting hole Be of the plate-making sheet B is not detected, or feeding of the plate-making sheet B is carried out during execution of print processing to normally complete printing, the backward end of the plate-making sheet B is detected and then discharged. This prevents the plate-making sheet B from being stopped halfway, but makes it possible to discharge the same in the reliable manner. A further advantage of this manner of feeding the plate-making sheet by the apparatus 1 is that the size of the apparatus 1 can be reduced through the use of a single optical sensor commonly used for detecting the forward end, detecting hole Be and backward end of the plate-making sheet B, and at the same time the apparatus 1 is made more reliable than when a mechanical sensor is employed.

In the embodiment described above, although the plate-making sheet B is immediately fed when an abnormality is detected, e.g. when the detecting hole Be cannot be detected, an alarm may be given first, e.g. by displaying a message on the display 24, notifying the user of the abnormality. Next, such a further embodiment of the invention will be described in detail with reference to FIGS. 21 and 22A to 22C.

Figure 21:
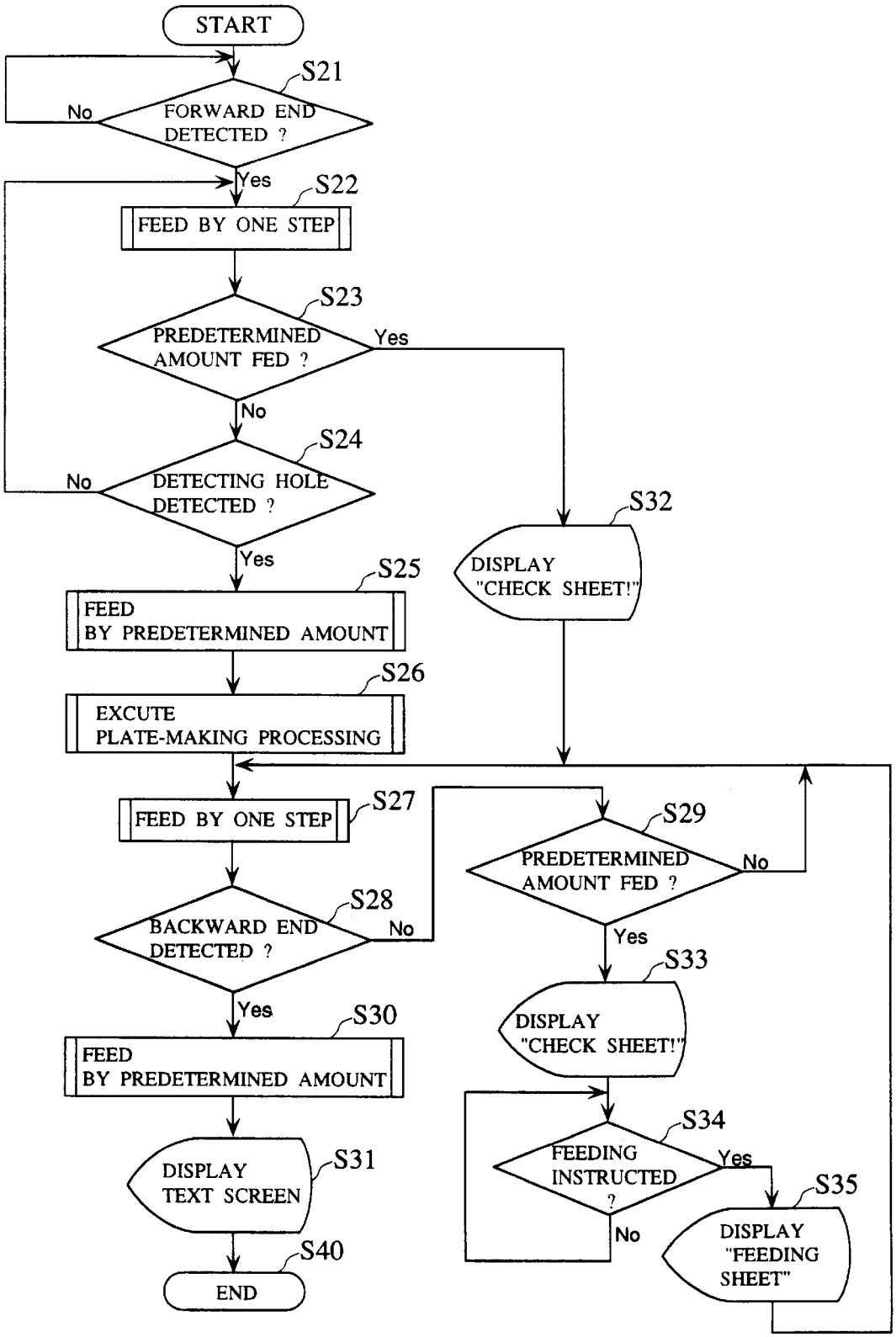
FIG. 21 is a flowchart of another example of the processing procedure, which is similar to FIG. 20 insertion to discharge of the plate-making sheet.

As described in FIG. 21, if the answer to the question of the step S23 is affirmative (YES), i.e. if the detecting hole Be is not detected during feeding of the plate-making sheet B by the certain amount (predetermined amount assigned to the forward end of the plate-making sheet B) (S22 to 24), a message of "CHECK SHEET!" as shown in FIG. 22A is displayed at a step S32. Then, feeding of the plate-making sheet B is continued (S27) until the backward end thereof is detected by the optical sensor 183. If the backward end is detected thereafter, i.e. if the answer to the question of the step S28 is affirmative (YES), the apparatus 1 further feeds the plate-making sheet B by a certain amount (predetermined amount to be fed for discharge) from a position of the plate-making sheet B where the backward end was detected, to thereby discharge the same (SN9 and S30). Then, a predetermined message is displayed on the display 24 at the step S31, followed by terminating the processing at the step S40.

On the other hand, if the answer to the question of the step S24 becomes affirmative (YES), while the answer to the question of the step S23 is negative (NO) i.e. if the detecting hole Be is detected during the feeding of the plate-making sheet B by the predetermined amount assigned to the forward end, just as in the above embodiment, the apparatus 1 further feeds the plate-making sheet by a certain amount (predetermined amount for locating the start of an image-forming area of a plate-making sheet of the plate-making sheet B) at the step S25 to thereby locate the start of the image-forming area. Then, at the step S26, print (plate-making) processing is executed.

As described above, according to the printing method and apparatus of the present embodiment, similarly to the first embodiment described hereinabove, with reference to a detecting hole Be (mark for detection) of a plate-making sheet B detected by the optical sensor 183, the plate-making sheet B is fed by a predetermined amount to locate the start of an image-forming area of a plate-making surface of the plate-making sheet. Therefore, the printing method and apparatus make it possible to print an image in a desired area on the plate-making surface of the plate-making sheet B by simple operations. On the other hand, when the mark for detection is not detected, e.g. when the plate-making sheet B is set with a wrong-side for print or when a plate-making sheet B of a non-conforming type has been inserted into the apparatus 1, an alarm is given to make the user aware of such an abnormality, whereby the user can deal with the abnormality promptly.

In addition to the effect of making the user aware of the abnormality, since only the feeding of the plate-making sheet B is permitted, it possible to discharge the plate-making sheet B in a reliable manner, and at the same time prevent other operations including printing from being executed in the abnormal state.

Then, as shown in FIG. 21, when the printing is completed at the step S26, the apparatus 1 further feeds the plate-making sheet B by a certain amount (predetermined amount to be fed after completion of the printing) at the step S27. Meanwhile, at the following step S28, it is determined whether or not the backward end of the plate-making sheet B was detected by the optical sensor 183 thereafter. If the answer to the question of the step S28 becomes affirmative (YES), the apparatus 1 further feeds the plate-making sheet B by a certain amount (predetermined amount to be fed for discharge) from a position of the plate-making sheet B where the backward end was detected, to thereby discharge the same at the step S30. Then, at the step S31, a predetermined message as shown in FIG. 22B is displayed on the display 24, followed by terminating the whole processing on the plate-making sheet B (S40).

On the other hand, as shown in the figure, if the answer to the question of the step S28 is negative (NO), i.e. if the backward end of the plate-making sheet B is not detected, it is determined at a step S29 whether or not the feeding of the plate-making sheet B by the specified amount (predetermined amount to be fed after completion of the printing) is completed. If the answer to the question of the step S29 is affirmative (YES), at the step S33 a massage such as "CHECK SHEET!" as shown in FIG. 22A is displayed on the display 24. Then, no manual operations to be executed in the normal state, including text entry, are disabled, but only the feeding of the plate-making sheet B is permitted to be executed by operating the predetermined push button 22*a* of the push button group 22 (at step S34) Then, at a step S35, a massage such as "FEEDING SHEET" as shown in FIG. 22C is displayed on the display 24, and the feeding of the plate-making sheet B is continued until the backward end thereof is detected, i.e. until the answer to the question of the step S28 becomes affirmative (YES) (S27 to 29 and S33 to 35).

As described above, according to the present embodiment, similarly to the embodiment described with reference to FIG. 20, the backward end of the plate-making sheet B is detected during the feeding of the plate-making sheet B by the predetermined amount after completion of printing, and then the plate-making sheet B is further fed by the predetermined amount for discharge, to thereby discharge the plate-making sheet in a reliable manner. On the other hand, when the backward end of the plate-making sheet B is not detected, the alarm is given to make the user aware of abnormality concerning detection of the backward end, so that the user aware of the abnormality can deal with the abnormality promptly. For example, when the plate-making sheet B was not fed properly during execution of printing causing free turning of the platen roller 57 or a twist of the ink ribbon C, resulting in an insufficient amount of feed of the plate-making sheet or when a plate-making sheet B of a non-conforming type has been inserted into the apparatus 1, the backward end of the plate-making sheet B cannot be detected during the feeding of the plate-making sheet B by the predetermined amount after completion of the printing, so that the alarm is given to make the user aware of the abnormality and urge him to deal with the abnormality. Further, not only is the warning given, but also all operations except feeding of the plate-making sheet B are inhibited, whereby it is possible to discharge the plate-making sheet B in a reliable manner without executing any other operation in the abnormal state.

It is further understood by those skilled in the art that the foregoing are preferred embodiments of the invention, and that various changes and modification may be made without departing from the spirit and scope thereof.

What is claimed is:

1. A printing method of printing an image on a plate-making surface of a plate-making sheet while feeding said plate-making sheet, said plate-making sheet being in the form of a strip and having a mark for detection provided at a predetermined location thereon, said printing method comprising the steps of:

feeding said plate-making sheet by a predetermined amount assigned to a forward end of said plate-making sheet when said forward end is detected by a sensor;

on one hand, further feeding said plate-making sheet by a predetermined amount for locating a start of an image-forming area of said plate-making surface of said plate-making sheet from a position of said plate-making sheet where said mark for detection is detected, when said mark for detection is detected by said sensor during said feeding of said plate-making sheet by said amount assigned to said forward end of said plate-making sheet, to thereby locate said start of said image-forming area of said plate-making surface of said plate-making sheet, but on the other hand, continuing feeding of said plate-making sheet when said mark for detection is not detected; and printing said image on said plate-making surface of said plate-making sheet based on print data according to an instruction for printing while feeding said plate-making sheet, when said start of said image-forming area of said plate-making surface has been located.

2. A printing method according to claim 1, wherein said mark for detection is provided in the vicinity of an upper-side edge and a lower-side edge of said plate-making sheet at centrosymmetric locations with respect to a center of said plate-making sheet.

3. A printing method according to claim 1, wherein said predetermined amount for locating said start of said image-forming area of said plate-making sheet is adjustable.

4. A printing method of printing an image on a plate-making surface of a plate-making sheet while feeding said plate-making sheet, said plate-making sheet being in the form of a strip and having a mark for detection provided at a predetermined location thereon, said printing method comprising the steps of:

feeding said plate-making sheet by a predetermined amount assigned to a forward end of said plate-making sheet when said forward end is detected by a sensor;

on one hand, further feeding said plate-making sheet by a predetermined amount for locating a start of an image-forming area of said plate-making surface of said plate-making sheet from a position of said plate-making sheet where said mark for detection is detected, when said mark for detection is detected by said sensor during said feeding of said plate-making sheet by said amount assigned to said forward end of said plate-making sheet, to thereby locate said start of said image-forming area of said plate-making surface of said plate-making sheet, but on the other hand, giving an alarm when said mark for detection is not detected, to make a user aware that there was an abnormality in detecting said mark for detection; and in response to an instruction for printing, printing said image on said plate-making surface of said plate-making sheet based on print data while feeding said plate-making sheet, when said start of said image-forming area of said plate-making surface has been located.

5. A printing method according to claim 4, wherein only feeding of said plate-making sheet is permitted when said mark for detection is not detected.

6. A printing method according to claim 5, wherein said predetermined amount for locating said start of said image-forming area of said plate-making sheet is adjustable.

7. A printing method according to claim 4, wherein said mark for detection is provided in the vicinity of an upper-side edge and a lower-side edge of said plate-making sheet at centrosymmetric locations with respect to a center of said plate-making sheet.

8. A printing method according to claim 4, wherein said predetermined amount for locating said start of said image-forming area of said plate-making sheet is adjustable.

9. A printing method according to any one of claims 1 to 8, further including a step of feeding said plate-making sheet by a predetermined amount from a position of said plate-making sheet where a backward end of said plate-making sheet is detected, in response to a detection signal delivered by said sensor when said backward end of said plate-making sheet is detected, to thereby discharge said plate-making sheet.

10. A printing method according to any one of claims 1 to 8, further including steps of:

on one hand, feeding said plate-making sheet after completion of said printing by a predetermined amount from a position of said plate-making sheet where said printing is completed; and on the other hand, feeding said plate-making sheet by a predetermined amount from a position of said plate-making sheet where said backward end is detected, when said backward end is detected by said sensor during said feeding of said plate-making sheet by said predetermined amount after completion of said printing, to thereby discharge said plate-making sheet, but giving an alarm when said backward end is not detected to make a user aware that there was an abnormality in detecting said backward end of said plate-making sheet.

11. A printing method according to claim 10, wherein only feeding of said plate-making sheet is permitted when said backward end is not detected.

12. A printing apparatus for printing an image on a plate-making surface of a plate-making sheet while feeding said plate-making sheet, said plate-making sheet being in the form of a strip and having a mark for detection provided at a predetermined location thereon, said printing apparatus comprising:

feeding means for feeding a plate-making sheet;

a print head for printing an image on said plate-making surface of said plate-making sheet based on print data;

a sensor arranged at a location upstream of said print head; and control means for controlling operation of said feeding means and operation of said print head in response to a detection signal delivered by said sensor, wherein said control means causes said feeding means to feed said plate-making sheet by a predetermined amount assigned to a forward end of said plate-making sheet when said forward end is detected by said sensor, and wherein when said mark for detection is detected by said sensor during said feeding of said plate-making sheet by said feeding means by said predetermined amount assigned to said forward end of said plate-making sheet, said control means causes said feeding means to further feed said plate-making sheet by a predetermined amount for locating a start of an image-forming area of said plate-making surface of said plate-making sheet, from a position of said plate-making sheet where said mark for detection is detected, to thereby locate said start of said image-forming area of said plate-making surface of said plate-making sheet, and causes said print head to execute printing while causing said feeding means to feed said plate-making sheet, whereas when said mark for detection is not detected, said control means causes said feeding means to continue feeding of said plate-making sheet.

13. A printing apparatus according to claim 12, wherein said mark for detection is provided in the vicinity of an upper-side edge and a lower-side edge of said plate-making sheet at centrosymmetric locations with respect to a center of said plate-making sheet.

14. A printing apparatus according to claim 12, wherein said control means is capable of adjusting said predetermined amount for locating said start of said image-forming area of said plate-making sheet.

15. A printing apparatus according to claim 12, wherein said predetermined amount assigned to said forward end of said plate-making sheet is equal to an amount of feed corresponding to one to ten seconds in terms of time over which said plate-making sheet is fed.

16. A printing apparatus according to claim 12, wherein insertion of said plate-making sheet is always permitted except in specified cases.

17. A printing apparatus for printing an image on a plate-making surface of a plate-making sheet while feeding said plate-making sheet, said plate-making sheet being in the form of a strip and having a mark for detection provided at a predetermined location thereon, said printing apparatus comprising:

feeding means for feeding a plate-making sheet;

alarm means for giving an alarm when an abnormality occurs;

a print head for printing an image on said plate-making surface of said plate-making sheet based on print data;

a sensor arranged at a location upstream of said print head; and control means for controlling operation of said feeding means, operation of said alarm means, and operation of said print head in response to a detection signal delivered by said sensor, wherein said control means causes said feeding means to feed said plate-making sheet by a predetermined amount assigned to a forward end of said plate-making sheet when said forward end is detected by said sensor, and wherein when said mark for detection is detected by said sensor during said feeding of said plate-making sheet by said feeding means by said predetermined amount assigned to said forward end of said plate-making sheet, said control means causes said feeding means to further feed said plate-making sheet by a predetermined amount for locating a start of an image-forming area of said plate-making surface of said plate-making sheet, from a position of said plate-making sheet where said mark for detection is detected, to thereby locate said start of said image-forming area of said plate-making surface of said plate-making sheet, and causes said print head to execute printing while causing said feeding means to feed said plate-making sheet, whereas when said mark for detection is not detected, said control means causes said alarm means to give an alarm to make a user aware that there was an abnormality in detecting said mark for detection.

18. A printing apparatus according to claim 17, wherein said control means permits only feeding of said plate-making sheet when said mark for detection is not detected by said sensor.

19. A printing apparatus according to claim 17, wherein said mark for detection is provided in the vicinity of an upper-side edge and a lower-side edge of said plate-making sheet at centrosymmetric locations with respect to a center of said plate-making sheet.

20. A printing apparatus according to claim 17, wherein said control means is capable of adjusting said predetermined amount for locating said start of said image-forming area of said plate-making sheet.

21. A printing apparatus according to claim 17, wherein said predetermined amount assigned to said forward end of said plate-making sheet is equal to an amount of feed corresponding to one to ten seconds in terms of time over which said plate-making sheet is fed.

22. A printing apparatus according to claim 17, wherein insertion of said plate-making sheet is always permitted except in specified cases.

23. A printing apparatus according to any one of claims 12 to 22, wherein said control means causes said feeding means to feed said plate-making sheet by a predetermined amount from a position of said plate-making sheet where a backward end of said plate-making sheet is detected, in response to a detection signal delivered by said sensor when said backward end is detected, to thereby discharge said plate-making sheet.

24. A printing apparatus according to any one of claims 12 to 22, wherein said forward end, said mark for detection and said backward end are detected by a single optical sensor.

25. A printing apparatus according to claim 12, further including alarm means for giving an alarm when an abnormality occurs, wherein said control means further controls operation of said alarm means, and wherein said control means causes said feeding means to feed said plate-making sheet after completion of said printing by a predetermined amount from a position of said plate-making sheet where printing is completed, and wherein when said backward end is detected by said sensor during said feeding of said plate-making sheet by said predetermined amount after said completion of said printing, said control means causes said feeding means to further feed said plate-making sheet by a predetermined amount from a position of said plate-making sheet where said backward end is detected, to thereby discharge said plate-making sheet, whereas when said backward end of said plate-making sheet is not detected by said sensor, said control means causes said alarm means to give an alarm to make a user aware that there was an abnormality in detecting said backward end.

26. A printing apparatus according to claim 25, wherein said control means permits only feeding of said plate-making sheet when said backward end is not detected by said sensor.

27. A printing apparatus according to claim 17, wherein said control means causes said feeding means to feed said plate-making sheet after completion of said printing by a predetermined amount from a position of said plate-making sheet where printing is completed, and wherein when said backward end is detected by said sensor during said feeding of said plate-making sheet by said predetermined amount after said completion of said printing, said control means causes said feeding means to further feed said plate-making sheet by a predetermined amount from a position of said plate-making sheet where said backward end is detected, to thereby discharge said plate-making sheet, whereas when said backward end of said plate-making sheet is not detected by said sensor, said control means causes said alarm means to give an alarm to make a user aware that there was an abnormality in detecting said backward end.

28. A printing apparatus according to claim 27, wherein said control means permits only feeding of said plate-making sheet when said backward end is not detected by said sensor.

29. A printing method of printing an image on a plate-making surface of a plate-making sheet while feeding said plate-making sheet, said plate making sheet being in the form of a strip having a mark for detection provided at a predetermined location thereon, said printing method comprising the steps of:

detecting by a sensor a forward end of said plate-making sheet inserted;

feeding said plate-making sheet by a predetermined amount assigned to said forward end of said plate-making sheet when said forward end of said plate-making sheet is detected by said sensor;

discriminating whether or not there is said mark for detection when said predetermined amount of said plate-making sheet is fed.

30. A printing method according to claim 29, further comprising the step of:

printing data on a specified area on said plate-making surface of said plate-making sheet while further feeding plate-making sheet when said mark for detection is discriminated.

31. A printing method according to claim 29, further comprising the step of:

not printing data on said plate-making surface of said plate-making sheet when said mark for detection is not discriminated.

32. A printing method according to claim 31, further comprising the step of:

discharging the plate-making sheet that is not printed from a sheet exit.

33. A printing method according to claim 31, further comprising the step of:

giving an alarm to make the user aware of the abnormality of insertion of the plate-making sheet.

34. A printing apparatus for printing an image on a plate-making surface of a plate-making sheet while feeding said plate-making sheet, said plate-making sheet being in the form of a strip and having a mark for detectin provided at a predetermined location thereon, said printing apparatus comprising:

detecting means for detecting by a sensor a forward end of said plate-making sheet inserted;

feeding means for deeding said plate-making sheet by a predetermined amount assigned to said forward end of said plate-making sheet when said forward end of said plate-making sheet is detected by said sensor;

discriminating means for discriminating whether or not there is said mark for detection when said predetermined amount of said plate-making is fed;

printing means for printing data on a specified area on said plate-making surface of said plate-making sheet while further feeding said plate-making sheet when said mark for detection is discriminated.

35. A printing apparatus for printing an image on a plate-making surface of a plate-making sheet while feeding said plate-making sheet, said plate-making sheet being in the form of a strip and having a mark for detection provided at a predetermined location thereon, said printing apparatus comprising:

a detecting device having a sensor that detects a forward end of said plate-making sheet inserted;

a feeding device that feeds said plate-making sheet by a predetermined amount assigned to said forward end of said plate-making sheet when said forward end of said plate-making sheet is detected by said sensor;

a discriminating device that discriminates whether or not there is said mark for detection when said predetermined amount of said plate-making is fed;

a printing device that prints data on a specified area on said plate-making surface of said plate-making sheet while further said plate-making sheet when said mark for detection is discriminated.

* * * * *

UNITED STATES PATENT AND TRADEMARK OFFICE

CERTIFICATE OF CORRECTION

PATENT NO. : 6,116,157
DATED : September 12, 2000
INVENTOR(S) : Hitoshi Hayama; Kenji Watanabe; Takanobu Kameda; Tomoyuki Shimmura It is certified that error appears in the above-identified patent and that said Letters Patent is hereby corrected as shown below:

Col. 1, section (73) ASSIGNEE, please add
KING JIM CO., LTD.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*